US009507315B2

(12) United States Patent
Iriyama et al.

(10) Patent No.: US 9,507,315 B2
(45) Date of Patent: Nov. 29, 2016

(54) DEVELOPING CARTRIDGE PROVIDED WITH SUPPLY ELECTRODE AND PROTECTING PORTION CAPABLE OF PROTECTING SUPPLY ELECTRODE

(71) Applicant: BROTHER KOGYO KABUSHIKI KAISHA, Nagoya-shi, Aichi-ken (JP)

(72) Inventors: Shota Iriyama, Toyokawa (JP); Soun Kanada, Nagoya (JP); Takashi Shimizu, Nagoya (JP); Atsushi Fukaya, Toyohashi (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/589,224

(22) Filed: Jan. 5, 2015

(65) Prior Publication Data

US 2015/0192892 A1 Jul. 9, 2015

(30) Foreign Application Priority Data

Jan. 6, 2014 (JP) ..... 2014-000602
Jan. 6, 2014 (JP) ..... 2014-000603
Jan. 6, 2014 (JP) ..... 2014-000604

(51) Int. Cl.
*G03G 15/00* (2006.01)
*G03G 21/16* (2006.01)

(52) U.S. Cl.
CPC ..... *G03G 21/1652* (2013.01); *G03G 21/1676* (2013.01)

(58) Field of Classification Search
CPC ..... G03G 21/1652; G03G 21/1676
USPC ..... 399/111, 119
See application file for complete search history.

(56) References Cited

U.S. PATENT DOCUMENTS

2011/0158685 A1 6/2011 Takagi et al.

FOREIGN PATENT DOCUMENTS

JP 2011-133766 A 7/2011

*Primary Examiner* — Quana M Grainger
(74) *Attorney, Agent, or Firm* — Merchant & Gould P.C.

(57) ABSTRACT

A developing cartridge mountable in a main casing of an image forming apparatus in a mounting direction includes: a supply roller; a casing; a supply electrode; and a first protecting portion. The supply roller rotates about an axis extending in a first direction orthogonal to the mounting direction. The casing includes first and second wall portions orthogonal to the first direction. The supply electrode is electrically connected to the supply roller and disposed adjacent to the second wall portion in the first direction. The first protecting portion protects the supply electrode and is disposed downstream of the supply electrode in the mounting direction. The first protecting portion has a sloped surface having a first end and a second end upstream of the first end in the mounting direction. The sloped surface slopes away from the second wall portion in the first direction toward the second end.

22 Claims, 10 Drawing Sheets

DEVELOPING CARTRIDGE PROVIDED WITH SUPPLY ELECTRODE AND PROTECTING PORTION CAPABLE OF PROTECTING SUPPLY ELECTRODE

CROSS REFERENCE TO RELATED APPLICATION

This application claims priority from Japanese Patent Application Nos. 2014-000602 filed Jan. 6, 2014; 2014-000603 filed Jan. 6, 2014; and 2014-000604 filed Jan. 6, 2014. The entire content of each of the priority applications is incorporated herein by reference.

TECHNICAL FIELD

The present invention relates to a developing cartridge used in an image forming apparatus that employs an electrophotographic system.

BACKGROUND

One image-forming apparatus known in the art is a printer in which is detachably mounted a cartridge having a developing roller and a supply roller.

One such cartridge known in the art is a developing cartridge having a developing electrode electrically connected to a shaft of the developing roller. Further, this type of developing cartridge has a supply electrode electrically connected to a shaft of the supply roller.

The supply electrode in this conventional developing cartridge is configured to slide over a supply contact provided in the printer when the developing cartridge is mounted in the printer.

SUMMARY

However, the supply electrode in the conventional developing cartridge described above is exposed on the outside of the developing cartridge in order to slide over the supply contact in the printer. Consequently, when the developing cartridge is being mounted in and removed from the printer, the supply electrode is prone to contacting other components in the printer and becoming damaged as a result. Further, in a state where the developing cartridge is mounted in the printer, the supply electrode must contact the supply contact in the printer. Thus, when the developing cartridge is being mounted in the printer, the supply electrode may become damaged when contacting the supply contact in the printer.

In view of the foregoing, it is an object of the present invention to provide a developing cartridge that can suppress damage to the supply electrode when the developing cartridge is mounted in and removed from an image forming apparatus.

Further, as there has been demand in recent years to make smaller printers, there has been an accompanying need to reduce the size of the developing cartridge mounted in the printer.

However, in attempts to reduce the size of the conventional developing cartridge described above, the supply electrode is sometimes made to protrude out from a frame of the developing cartridge in order to provide sufficient contact area between the supply electrode and the supply contact in the printer. With this configuration, the supply electrode is prone to contacting other components in the printer and is thus susceptible to becoming damaged.

In view of the foregoing, it is another object of the present invention to provide a developing cartridge that can be made more compact while protecting the supply electrode.

In order to attain the above and other objects, the present invention provides a developing cartridge configured to be mounted in a main casing of an image forming apparatus in a mounting direction. The developing cartridge may include: a developing roller; a supply roller; a casing; a developing electrode; a supply electrode; and a first protecting portion. The developing roller may be configured to rotate about a first rotation axis extending in a first direction that is orthogonal to the mounting direction. The supply roller may be configured to rotate about a second rotation axis extending in the first direction and configured to supply the developing roller with developer. The casing may be configured to accommodate developer therein. The casing may include a first wall portion orthogonal to the first direction and a second wall portion orthogonal to the first direction and facing the first wall portion in the first direction. The first direction may be a direction from the first wall portion toward the second wall portion. The developing electrode may be configured to be electrically connected to the developing roller and disposed at a position adjacent to the second wall portion in the first direction. The supply electrode may be configured to be electrically connected to the supply roller and disposed at a position adjacent to the second wall portion in the first direction. The first protecting portion may be configured to protect the supply electrode and disposed at a position downstream of the supply electrode in the mounting direction. The first protecting portion may have a sloped surface having a first end and a second end upstream of the first end in the mounting direction. The sloped surface may slope away from the second wall portion in the first direction toward the second end.

According to another aspect, the present invention provides a developing cartridge that may include: a developing roller; a supply roller; a supply electrode; and a casing. The developing roller may be configured to rotate about a first rotation axis extending in a first direction. The supply roller may be configured to rotate about a second rotation axis extending in the first direction and configured to supply the developing roller with developer. The supply electrode may be configured to be electrically connected to the supply roller. The casing may be configured to accommodate developer therein. The casing may include a first frame and a second frame assembled to the first frame. The second frame may include: a first wall portion; a second wall portion; a joining portion; a cover portion; and a connecting portion. The first wall portion may extend in a second direction that is orthogonal to the first direction. The second wall portion may extend in the second direction and face the first wall portion in the first direction. The first direction may be a direction from the first wall portion to the second wall portion. The supply electrode may be disposed at a position adjacent to the second wall portion in the first direction. The joining portion may protrude in the first direction from the second wall portion and be assembled to the first frame. The cover portion may protrude in the first direction from the second wall portion and cover the supply electrode. The cover portion may have a first end connected to the second wall portion and a second end opposite to the first end in the first direction. The connecting portion may connect the joining portion and the second end of the cover portion.

According to still another aspect, the present invention provides a developing cartridge that may include: a developing roller; a supply roller; a supply electrode; and a casing. The developing roller may be configured to rotate about a first rotation axis extending in a first direction. The supply roller may be configured to rotate about a second rotation axis extending in the first direction and configured to supply the developing roller with developer. The supply electrode may be configured to be electrically connected to the supply roller. The casing may be configured to accommodate developer therein. The casing may include a first frame and a second frame. The second frame may have a joining surface joined to the first frame. The second frame may include a rib disposed at a position adjacent to the supply electrode. The rib may protrude further than the joining surface in a second direction that is orthogonal to the joining surface.

DETAILED DESCRIPTION

1. Overall Structure of Developing Cartridge

Figures 1A, 1B:
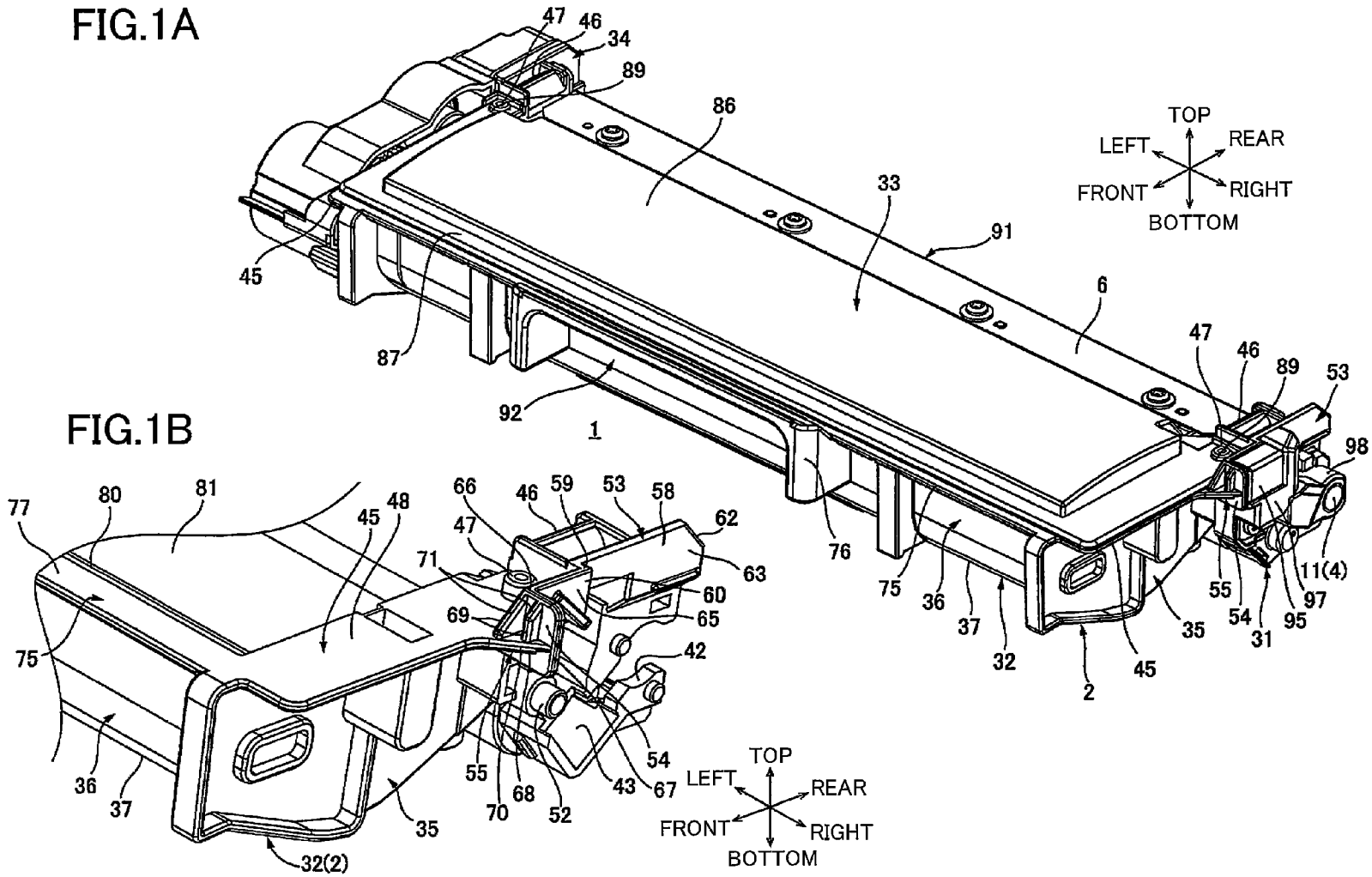
FIG. 1A is a perspective view of a developing cartridge according to a first embodiment of the present invention as viewed from a right front side thereof.
FIG. 1B is a perspective view of a right end portion of a base frame of the developing cartridge shown in FIG. 1A as viewed from a right front side thereof.

A developing cartridge 1 according to a first embodiment of the present invention that is detachably mountable in a printer 15 as an example of an image forming apparatus will be described with reference to FIGS. 1A through 2 wherein like parts and components are designated by the same reference numerals to avoid duplicating description.

Figure 2:
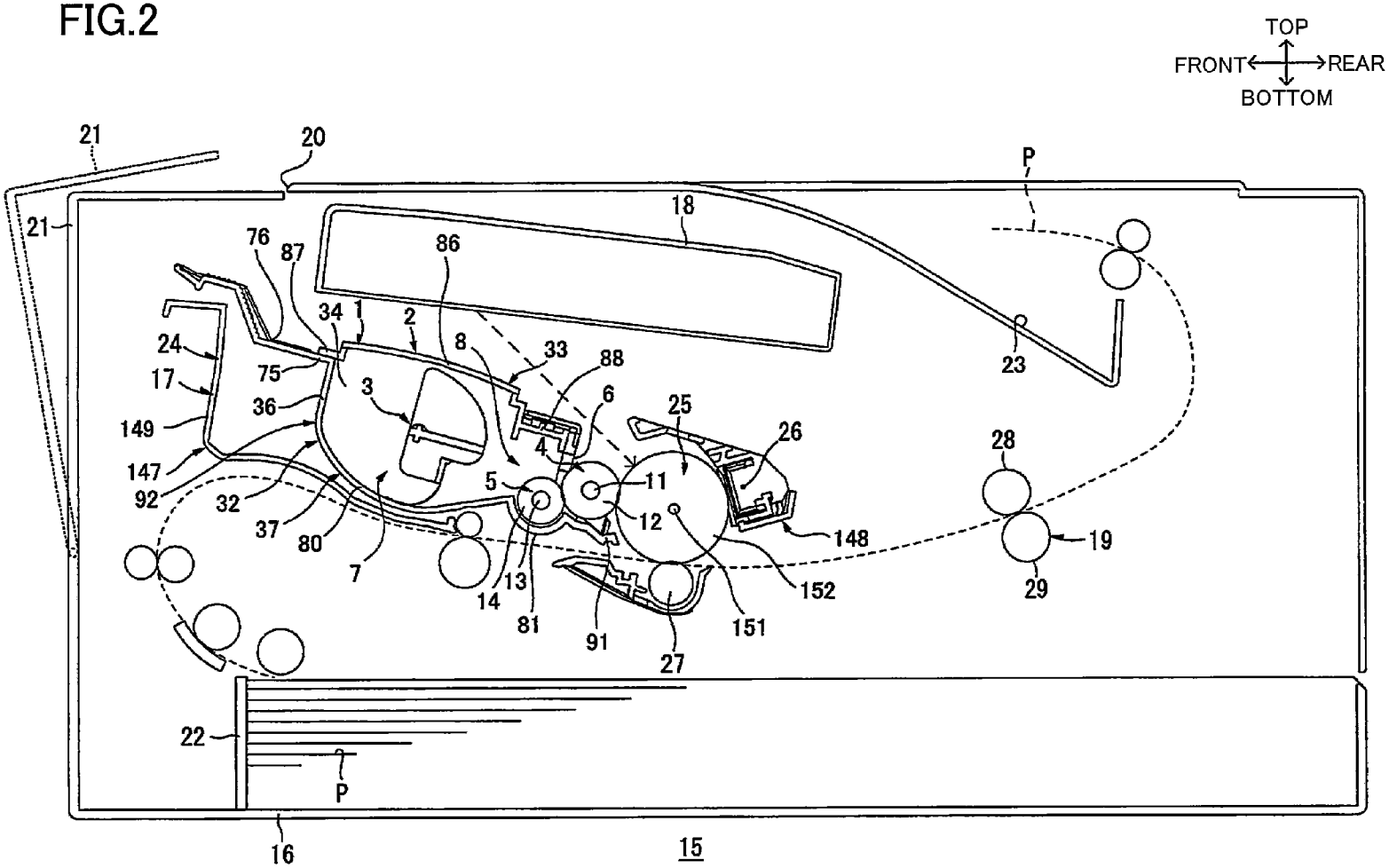
FIG. 2 is a center cross-sectional view of a printer in which the developing cartridge shown in FIG. 1A is mounted.

As shown in FIGS. 1A, 1B and 2, the developing cartridge 1 includes a developing-cartridge frame 2 as an example of a casing, an agitator 3, a developing roller 4, a supply roller 5, and a layer thickness regulation blade 6.

In the following description, a side of the developing cartridge 1 on which the developing roller 4 is provided will be referred to as a rear side of the developing cartridge 1, and a side of the developing cartridge 1 opposite to the side where the developing roller 4 is provided will be referred to as a front side of the developing cartridge. Left and right sides of the developing cartridge 1 in the following description will be based on the reference point of the operator viewing the developing cartridge 1 from the front side. Directions related to the developing cartridge 1 specifically will refer to the directions indicated by arrows in the drawings.

Note that a front-to-rear direction is an example of a mounting direction of the developing cartridge 1. Further, a front side is an example of an upstream side in the mounting direction while a rear side is an example of a downstream side in the mounting direction.

The developing-cartridge frame 2 is formed in a general box-like shape that is elongated in the left-right direction. The developing-cartridge frame 2 has a rear end portion that opens in the front-rear direction. As shown in FIG. 2, a toner-accommodating chamber 7 and a development chamber 8 are arrayed in the front-rear direction in an interior of the developing-cartridge frame 2. The toner-accommodating chamber 7 accommodates toner as an example of a developer therein.

The agitator 3 is rotatably provided in an approximate front-rear and vertical center region of the toner-accommodating chamber 7.

The developing roller 4 is rotatably supported in a rear end portion of the development chamber 8. The developing roller 4 includes a developing-roller shaft 11 and a developing-roller body 12. The developing-roller shaft 11 is formed in a general columnar shape that is elongated in the left-right direction. The developing-roller body 12 covers an approximate left-right center region of the developing-roller shaft 11. The developing-roller body 12 is exposed outside the developing-cartridge frame 2 at its upper and rear portions.

The supply roller 5 is rotatably supported in the development chamber 8 at a position frontward and downward of the developing roller 4. The supply roller 5 includes a supply-roller shaft 13 and a supply-roller body 14. The supply-roller shaft 13 is formed in a general columnar shape that is elongated in the left-right direction. The supply-roller body 14 covers an approximate left-right center region of the supply roller-shaft 13. The supply-roller body 14 has an upper rear edge portion that is in pressure contact with a lower front edge portion of the developing roller body 12.

The layer thickness regulation blade 6 is provided in the development chamber 8 at a position above and frontward of the developing roller 4. As shown in FIGS. 2 and 3A, the layer thickness regulation blade 6 is supported in the developing-cartridge frame 2 such that a lower edge portion of the layer thickness regulation blade 6 is in contact with an upper front edge portion of the developing roller 4.

2. Overall Structure of Pinter

As shown in FIG. 2, the printer 15 is an electrophotographic type monochromatic printer. The printer 15 includes a main casing 16 as an example of a main casing, a process cartridge 17, a scanning unit 18, and a fixing unit 19.

Directions in the following description related to the printer 15 will be given based on a state of the printer 15 when the printer 15 is resting on a level surface, and specifically will refer to the directions indicated by arrows in FIG. 2.

Incidentally, the top, bottom, front, and rear directions related to the printer 15 differ slightly from the top, bottom, front, and rear directions related to the developing cartridge 1. When the developing cartridge 1 is mounted in the printer 15, the front side of the developing cartridge 1 faces the upper front side of the printer 15, and the rear side of the developing cartridge 1 faces the lower rear side of the printer 15, as shown in FIG. 2.

The main casing 16 has a generally box-like shape. The main casing 16 includes a front cover 21, a sheet supply tray 22, and a sheet discharge tray 23.

The main casing 16 has an access opening 20 for allowing passage of the process cartridge 17. The access opening 20 is formed in a front wall of the main casing 16 and penetrates the front wall in the front-rear direction.

The front cover 21 has a general plate-like shape that is substantially L-shaped in a side view. The front cover 21 is supported to the front wall of the main casing 16 so as to be pivotally movable about its lower end portion between an open position for opening the access opening 20 and a closed position for closing the access opening 20.

The sheet supply tray 22 is provided at a bottom portion of the main casing 16. The sheet supply tray 22 is adapted to accommodate sheets P of paper therein.

The sheet discharge tray 23 is provided on a top surface of the main casing 16.

The process cartridge 17 is configured to be mounted in and removed from the main casing 16 through the access opening 20. The process cartridge 17 includes a drum cartridge 24 and the developing cartridge 1.

The drum cartridge 24 includes a photosensitive drum 25, a scorotron charger 26, and a transfer roller 27.

The photosensitive drum 25 is rotatably supported in a rear end portion of the drum cartridge 24. The photosensitive drum 25 has a general cylindrical shape that is elongated in the left-right direction.

The scorotron charger 26 is positioned rearward of the photosensitive drum 25 and is spaced apart from the photosensitive drum 25.

The transfer roller 27 is positioned below the photosensitive drum 25. The transfer roller 27 contacts a lower edge portion of the photosensitive drum 25.

The developing cartridge 1 is configured to be mounted in and removed from the drum cartridge 24. In a state where the developing cartridge 1 is mounted in the drum cartridge 24, a rear edge portion of the developing roller 4 contacts a front edge portion of the photosensitive drum 25.

The scanning unit 18 is disposed above the process cartridge 17. The scanning unit 18 is adapted to irradiate a laser beam based on image data toward the photosensitive drum 25, as indicated by a broken line in FIG. 2.

The fixing unit 19 is disposed rearward of the process cartridge 17. The fixing unit 19 includes a heating roller 28 and a pressure roller 29. The pressure roller 29 is positioned below and rearward of the heating roller 28, and contacts a lower rear edge portion of the heating roller 28 with pressure.

When the printer 15 starts an image-forming operation under control by a controller (not shown), the scorotron charger 26 applies a uniform charge to a surface of the photosensitive drum 25. Subsequently, the scanning unit 18 exposes the surface of the photosensitive drum 25 to the laser beam, thereby forming an electrostatic latent image based on image data on the surface of the photosensitive drum 25.

In the meantime, the supply roller 5 supplies the toner accommodated in the developing-cartridge frame 2 to the developing roller 4. At this time, the toner is positively tribocharged between the developing roller 4 and the supply roller 5, and carried on the developing roller 4. The layer thickness regulation blade 6 regulates the thickness of the toner carried on the developing roller 4 into a uniform thickness.

Next, the toner carried on the developing roller 4 is supplied to the electrostatic latent image formed on the surface of the photosensitive drum 25, producing a toner image corresponding to the electrostatic latent image on the surface of the photosensitive drum 25.

Various rollers in the printer 15 rotate to convey the sheets P from the sheet supply tray 22, and supply the sheets P one sheet at a time between the photosensitive drum 25 and the transfer roller 27 at a prescribed timing. As the sheet P passes between the photosensitive drum 25 and the transfer roller 27, the toner image on the surface of the photosensitive drum 25 is transferred onto the sheet P.

Subsequently, the heating roller 28 and the pressure roller 29 apply heat and pressure to the sheet P as the sheet P passes therebetween. At this time, the toner image is thermally fixed onto the sheet P. Then, the sheet P is discharged onto the sheet discharge tray 23.

3. Detailed Description of Developing Cartridge

Figure 6B:
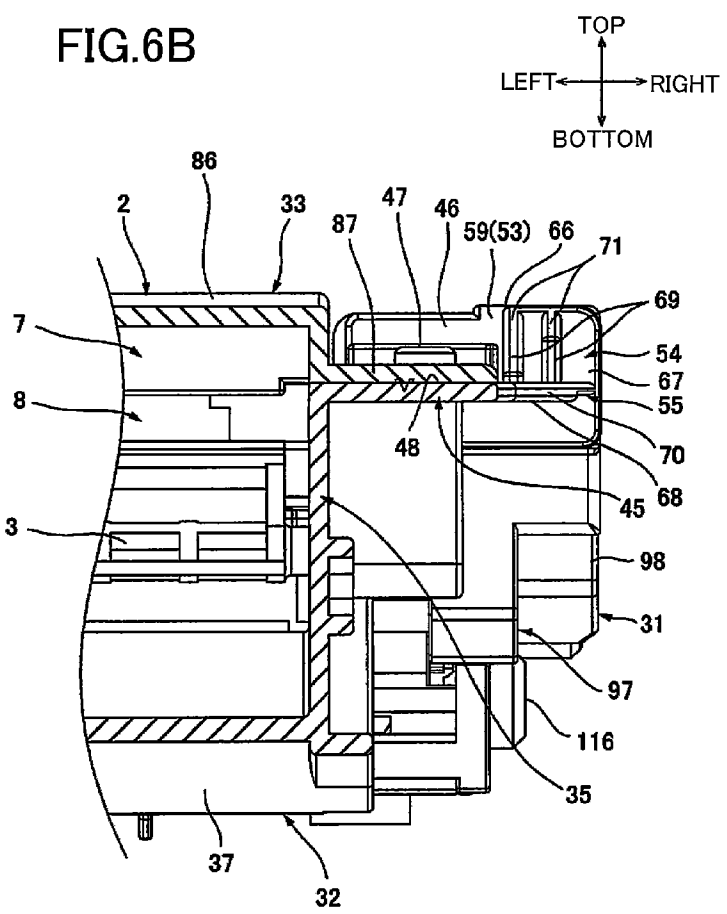
FIG. 6B is a cross-sectional view of the right end portion of the developing cartridge taken along a line A-A in FIG. 6A.
Figure 6A:
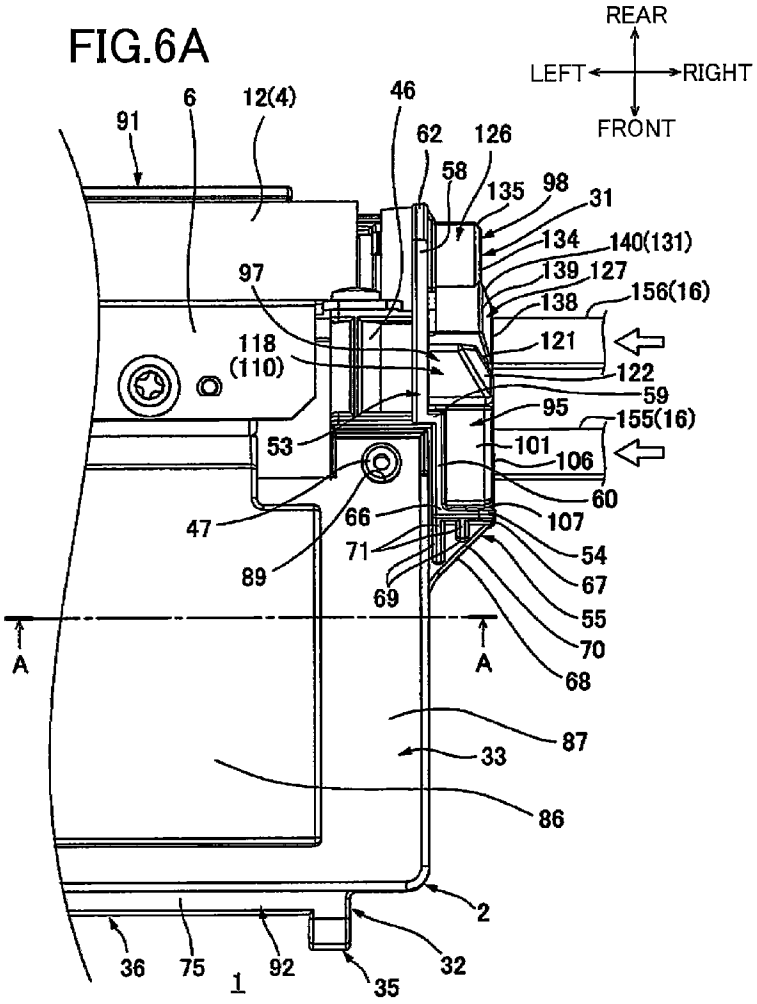
FIG. 6A is a plan view of a right end portion of the developing cartridge mounted in the printer shown in FIG. 2.

As shown in FIGS. 1A and 6A, the developing cartridge 1 includes the developing-cartridge frame 2 described above, and a power supply unit 31.

(1) Developing-Cartridge Frame

As shown in FIGS. 2 and 6B, the developing-cartridge frame 2 includes a base frame 32 as an example of a second frame, and a cover frame 33 as an example of a first frame.

(1-1) Base Frame

The base frame 32 includes a left wall 34, a right wall 35 as an example of a wall portion, a front wall 36, and a bottom wall 37.

As shown in FIGS. 1A and 2, the left wall 34 and the right wall 35 are respectively positioned on left and right ends of the developing-cartridge frame 2. The left wall 34 and the right wall 35 are generally plate-like-shaped and have a general rectangular shape in a side view that is elongated in the front-rear direction. In other words, the left wall 34 and the right wall 35 extend in a direction orthogonal to the left-right direction.

Figure 5B:
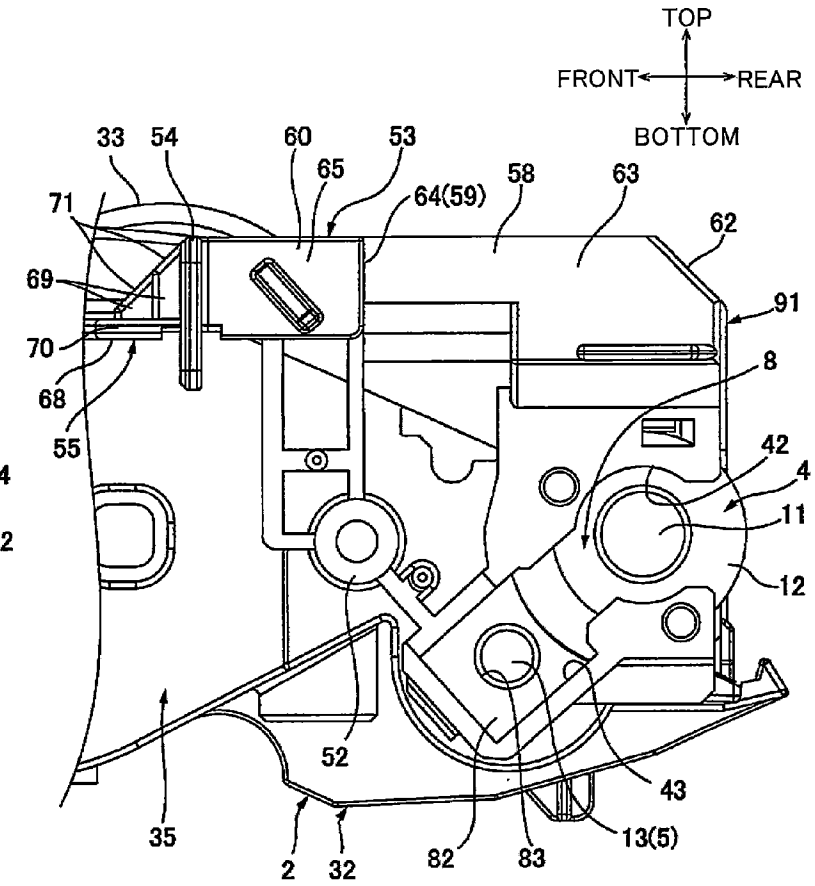
FIG. 5B is a right side view of the developing-cartridge frame shown in FIG. 5A.

As shown in FIGS. 1B and 5B, each of the left wall 34 and the right wall 35 includes a developing-roller-shaft insertion groove 42, a supply-roller-shaft insertion hole 43, a flange part 45 as an example of a joining portion, a blade support part 46 as an example of a support portion, and a positioning boss 47 as an example of a protruding portion.

Figure 3B:
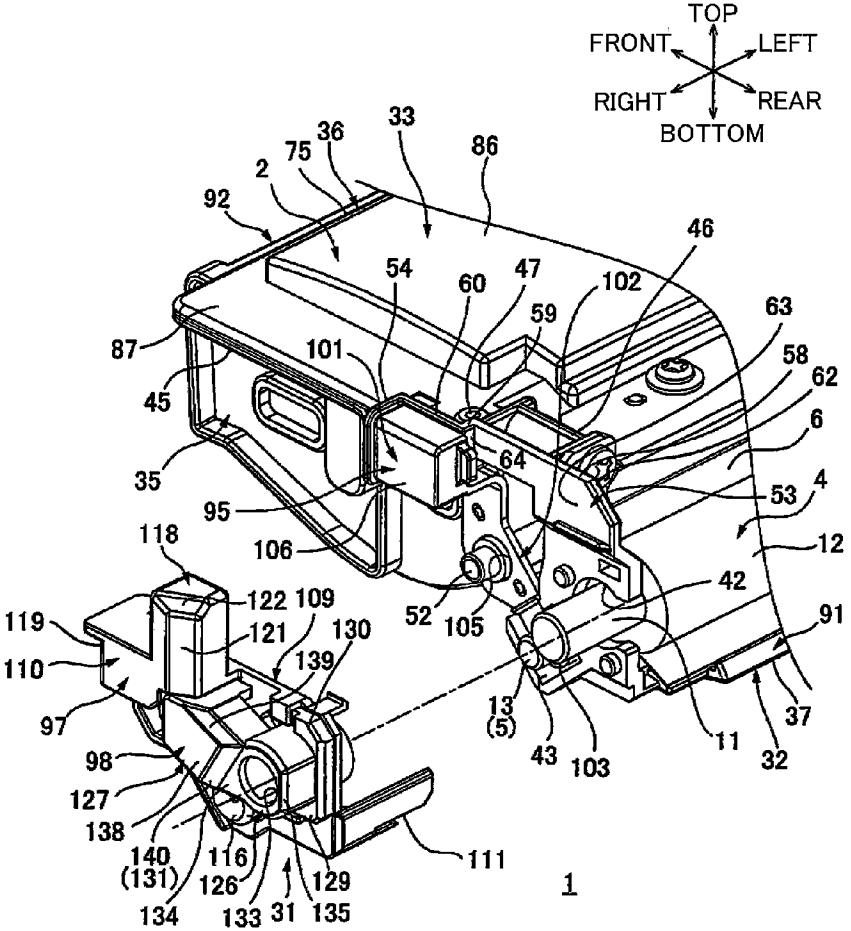
FIG. 3B is an exploded perspective view of a power supply unit shown in FIG. 3A as viewed from a right rear side thereof.
Figure 3A:
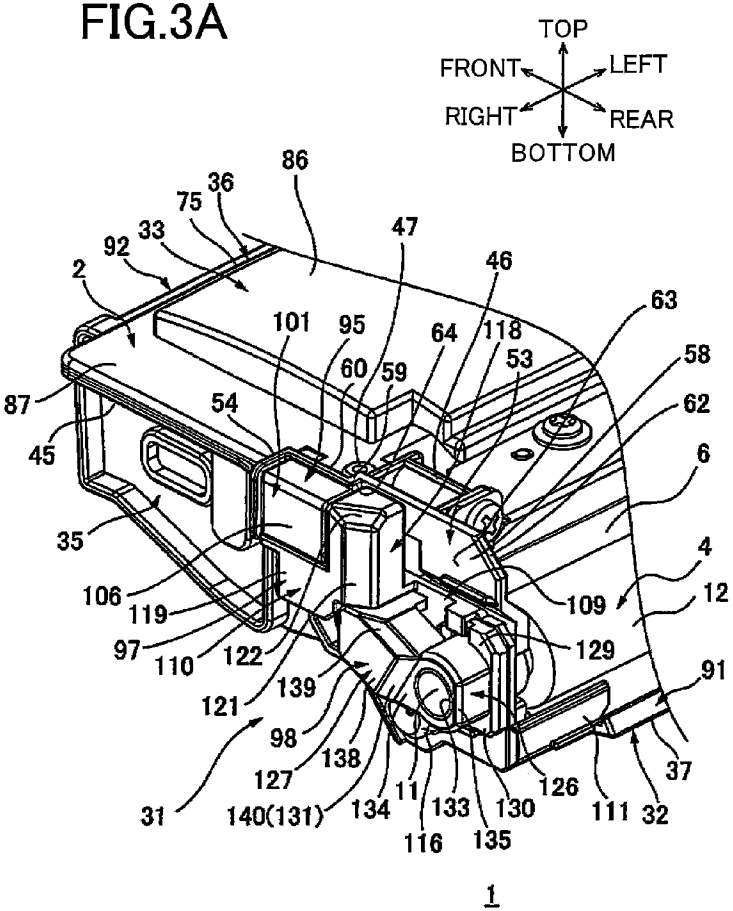
FIG. 3A is a perspective view of the right end portion of the developing cartridge shown in FIG. 1A as viewed from a right rear side thereof.

As shown in FIGS. 3B and 5B, the developing-roller-shaft insertion groove 42 is provided in an approximate vertical center region in a rear end portion of the corresponding left wall 34 and right wall 35. The developing-roller-shaft insertion groove 42 has a general C-shape in a side view that opens toward the rear. Thus, the developing-roller-shaft insertion groove 42 is recessed forward in a rear edge of the corresponding left wall 34 and right wall 35. The developing-roller-shaft insertion groove 42 has an inner diameter greater than an outer diameter of the developing-roller shaft 11.

As shown in FIG. 5B, the supply-roller-shaft insertion hole 43 is positioned on a lower front side of the developing-roller-shaft insertion groove 42. The supply-roller-shaft insertion hole 43 has a general rectangular shape in a side view and penetrates the corresponding left wall 34 and right wall 35. The supply-roller-shaft insertion hole 43 has inner dimensions larger than an outer diameter of the supply-roller shaft 13.

As shown in FIG. 1B, the flange part 45 has a general brim-like shape that protrudes outward in the left-right direction from a top edge of the corresponding left wall 34 and right wall 35 and extends forward along the top edge of the corresponding left wall 34 and right wall 35 from an approximate front-rear center thereof. The flange part 45 has a top surface defined as a joining surface 48.

As shown in FIGS. 1A and 1B, the blade support part 46 protrudes upward continuously from a rear end of the corresponding flange part 45 at an upper rear end portion of the corresponding left wall 34 and right wall 35. The blade support part 46 has a general prismatic columnar shape that is elongated in the front-rear direction. While not shown in the drawings, the blade support part 46 has a threaded hole that is recessed forward from its rear surface.

The positioning boss 47 is disposed on a rear end portion of the corresponding flange part 45. The positioning boss 47 has a general columnar shape that protrudes upward from the joining surface 48.

As shown in FIGS. 1B and 5B, the right wall 35 integrally includes an electrode support shaft 52, a first protruding wall 53 as an example of a rib, a second protruding wall 54 as an example of a third protecting portion and a cover portion, and a connecting part 55 as an example of a connecting portion.

The electrode support shaft 52 is disposed on a right surface of the right wall 35 at a position above and forward of the supply-roller-shaft insertion hole 43. The electrode support shaft 52 has a general columnar shape that protrudes rightward from the right surface of the right wall 35. A screw thread is formed on an inner circumferential surface of the electrode support shaft 52.

The first protruding wall 53 has a general plate-like shape that protrudes upward from a right edge of the right wall 35 in a rear portion thereof. The first protruding wall 53 has a crank-like shape in a plan view. As shown in FIG. 6B, the first protruding wall 53 extends above the flange part 45, with its top edge reaching substantially the same vertical position as a top edge of the blade support part 46. As shown in FIGS. 1B and 5B, the first protruding wall 53 includes a rear portion 58 as an example of a second portion, a bent portion 59 as an example of a third portion, and a front portion 60 as an example of a first portion.

The rear portion 58 constitutes a rear portion of the first protruding wall 53. The rear portion 58 has a general plate-like shape that protrudes upward from the right edge in the rear portion of the right wall 35. The rear portion 58 includes a chamfered part 62.

The chamfered part 62 is a cutout part forming an upper rear edge of the rear portion 58.

The rear portion 58 has a right surface defined as a rear flat surface 63. The rear flat surface 63 faces leftward and is elongated in the front-rear direction.

As shown in FIGS. 1B and 3B, the bent portion 59 constitutes an approximate front-rear center region of the first protruding wall 53. The bent portion 59 has a general plate-like shape that extends rightward from a front edge of the rear portion 58.

The bent portion 59 has a rear surface defined as a bent surface 64. The bent surface 64 faces rearward.

As shown in FIGS. 1B and 5B, the front portion 60 constitutes a front portion of the first protruding wall 53. The front portion 60 has a general plate-like shape that extends forward from a right edge of the bent portion 59.

The front portion 60 has a right surface defined as a front flat surface 65. The front flat surface 65 faces leftward and is elongated in the front-rear direction.

As shown in FIG. 6A, the rear portion 58 is arranged so as to be aligned with the blade support part 46, when projected in the left-right direction. Further, as shown in FIG. 6A, the front portion 60 is arranged so as to be aligned with the positioning boss 47, when projected in the left-right direction.

As shown in FIGS. 1B and 6B, the second protruding wall 54 is disposed in an approximate front-rear center region of the right wall 35. The second protruding wall 54 has a general plate-like shape that is substantially rectangular in a front view and elongated in the vertical direction. The second protruding wall 54 extends continuously rightward from a front edge of the front portion 60 of the first protruding wall 53. The second protruding wall 54 has a top edge that occupies substantially the same vertical position as the top edge of the first protruding wall 53. Hence, the top edge of the second protruding wall 54 extends above the flange part 45.

The second protruding wall 54 has a left end that is joined to the flange part 45 of the right wall 35. The left end of the second protruding wall 54 is defined as a cover left end 66 as an example of a first end. The second protruding wall 54 has a right end that is an opposite end from the cover left end 66. The right end of the second protruding wall 54 is defined as a cover right end 67 as an example of a second end.

In other words, the second protruding wall 54 is integrally formed with the flange part 45 and formed continuously with the joining surface 48.

The connecting part 55 connects the second protruding wall 54 and the right wall 35 and is configured to reinforce these members. The connecting part 55 includes a first rib 68, and a plurality of (two in the embodiment) second ribs 69.

As shown in FIGS. 1B and 6A, the first rib 68 has a general plate-like shape that connects an approximate front-rear center portion of a right edge of the right flange part 45 and a front surface of the cover right end 67 of the second protruding wall 54. The first rib 68 has a right edge that extends to a right edge of the second protruding wall 54. The first rib 68 has a front right portion that slopes rightward from front to rear, with the sloped surface being defined as a first sloped surface 70. Thus, the first rib 68 has a general triangular shape in a plan view.

The second ribs 69 are arranged at intervals in the left-right direction. The second ribs 69 have a general plate-like shape that connects a top surface of the first rib 68 and a front surface of the second protruding wall 54. The second ribs 69 have upper front portions that slope upward from front to rear, with the sloped surfaces being defined as second sloped surfaces 71.

Further, the left second rib 69 connects the top surface of the first rib 68 at its left end and the front surface of the second protruding wall 54 at its left end. In other words, the left second rib 69 is aligned with the front portion 60 of the first protruding wall 53 when projected in the front-rear direction. Further, by provision of the second sloped surface 71, the left second rib 69 has a general triangular shape in a side view.

Further, the right second rib 69 connects the top surface of the first rib 68 at its approximate left-right center and the front surface of the second protruding wall 54 at its approximate left-right center. Further, by provision of the second sloped surface 71, the right second rib 69 has a general trapezoidal shape in a side view.

As shown in FIGS. 1A and 2, the front wall 36 bridges a front edge of the left wall 34 and a front edge of the right wall 35. The front wall 36 has a general plate-like shape that is elongated in the left-right direction. The front wall 36 includes a flange part 75, and a grip part 76 as an example of a grip portion.

The flange part 75 has a general brim-like shape that extends forward from a top edge of the front wall 36 across its entire left-right dimension. The flange part 75 has a top surface defined as a joining surface 77.

The grip part 76 protrudes forward from a front surface of the front wall 36 in an approximate left-right center region thereof The bottom wall 37 bridges a bottom edge of the left wall 34 and a bottom edge of the right wall 35. As shown in FIG. 2, the bottom wall 37 has a general plate-like shape that curves while extending in the front-rear direction. The bottom wall 37 includes a curved wall 80, an arcuate wall 81, and supply-roller side seals 82 (see also FIGS. 5A and 5B).

As shown in FIG. 2, the curved wall 80 extends continuously rearward from a bottom edge of the front wall 36 and constitutes a portion of the bottom wall 37 forward of its center. The curved wall 80 has a general arcuate shape that conforms to a rotational path of the agitator 3.

The arcuate wall 81 has a general W-shape in cross-section and extends continuously rearward from a rear edge of the curved wall 80 in a rear region of the bottom wall 37. A front portion of the arcuate wall 81 has a general arcuate shape that conforms to a rotational path of the supply roller 5, while a rear portion of the arcuate wall 81 extends rearward therefrom.

Figure 5A:
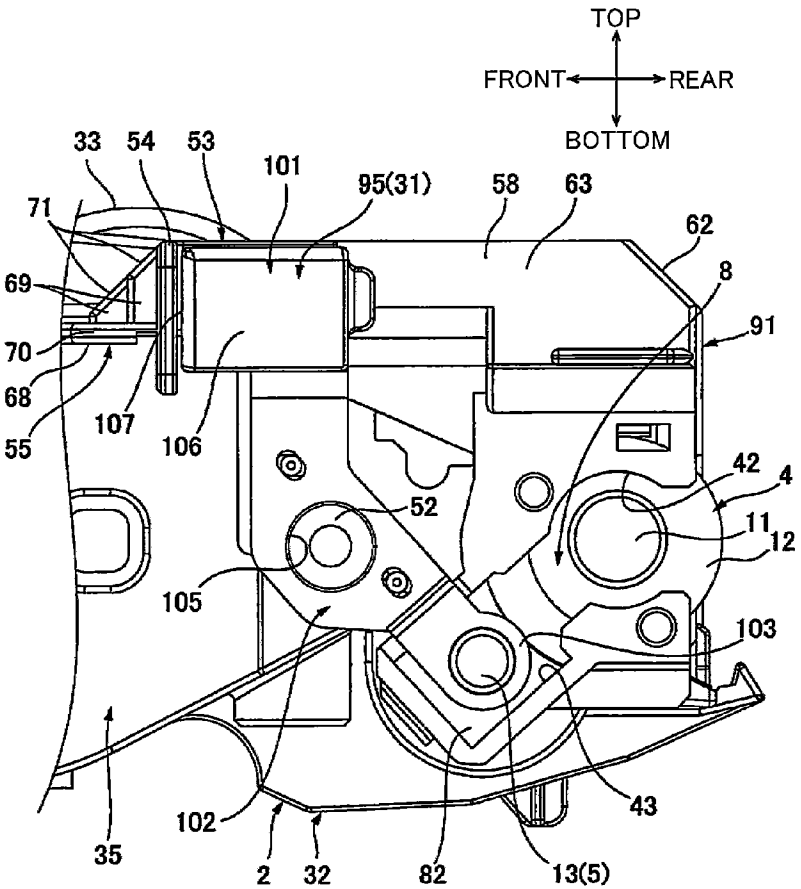
FIG. 5A is a right side view of a developing-cartridge frame of the developing cartridge shown in FIG. 1A, in which a supply electrode of the power supply unit shown in FIG. 3B is assembled to a right wall of the developing-cartridge frame.

As shown in FIGS. 5A and 5B, the supply-roller side seals 82 are disposed on a top surface of the arcuate wall 81 in a front portion thereof, with one on each of a left and right ends thereof. The supply-roller side seals 82 are formed of elastic members, such as sponge members. The supply-roller side seals 82 have a general rectangular shape in a side view and are elongated in the front-rear direction. A supply-roller-shaft insertion hole 83 is formed in each of the supply-roller side seals 82.

The supply-roller-shaft insertion holes 83 have a circular shape in a side view and penetrate an approximate center region in a side view of the supply-roller side seals 82. In a side view, the supply-roller-shaft insertion holes 83 are exposed through the corresponding supply-roller-shaft insertion holes 43. The supply-roller-shaft insertion holes 83 support the supply roller 5 by receiving left and right ends of the supply-roller shaft 13 such that the left and right ends are positioned farther outward in the left-right direction than the respective left wall 34 and right wall 35.

(1-2) Cover Frame

As shown in FIGS. 1A and 2, the cover frame 33 integrally includes an expanded part 86, a welding part 87, and a blade-mounting part 88.

As shown in FIG. 1A, the expanded part 86 constitutes an approximate center region of the cover frame 33 in a plan view. The expanded part 86 expands upward.

The welding part 87 is arranged to surround the expanded part 86. More specifically, the welding part 87 is arranged on outer left and right sides and a front side of the expanded part 86. Thus, the welding part 87 has a general plate-like shape that is substantially U-shaped in a plan view. When projected in the vertical direction, a left portion of the welding part 87 overlaps the flange part 45 of the left wall 34, a right portion of the welding part 87 overlaps the flange part 45 of the right wall 35, and a front portion of the welding part 87 overlaps the flange part 75 of the front wall 36. A pair of positioning holes 89 as an example of a through-hole is formed in the welding part 87.

The positioning holes 89 are formed in a rear edge of the welding part 87, with one on each of left and right ends thereof. The positioning holes 89 have a general circular shape in a plan view and penetrate the welding part 87 in the vertical direction. The positioning holes 89 are positioned to correspond to the positioning bosses 47 provided on the left wall 34 and the right wall 35, and are formed in a size capable of receiving the respective positioning bosses 47.

As shown in FIG. 2, the blade-mounting part 88 has a general plate-like shape and extends continuously rearward from a rear edge of the expanded part 86.

(1-3) Developing Frame

As shown in FIGS. 1A and 6B, the developing-cartridge frame 2 is configured by assembling the base frame 32 and the cover frame 33 together.

More specifically, the cover frame 33 is positioned relative to the base frame 32 by inserting the positioning boss 47 of the left wall 34 into the left positioning hole 89 and by inserting the positioning boss 47 of the right wall 35 into the right positioning hole 89. At this time, a bottom surface of the welding part 87 of the cover frame 33 is in contact with a top edge of the base frame 32, and specifically with the joining surfaces 48 of the flange parts 45 of the respective left wall 34 and right wall 35, and the joining surface 77 of the flange part 75 of the front wall 36. Assembly of the cover frame 33 to the base frame 32 is completed by welding the welding part 87 to these surfaces.

In the developing-cartridge frame 2 configured as described above, a rear edge of the developing-cartridge frame 2, i.e., an edge in the front-rear direction at which the developing roller 4 is disposed, is defined as a first edge 91, while a front edge, i.e., an edge on an opposite side in the front-rear direction to the first edge 91 at which the grip part 76 is disposed, is defined as a second edge 92.

As shown in FIG. 2, the toner-accommodating chamber 7 is a space in a front region of the developing-cartridge frame 2. Specifically, the toner-accommodating chamber 7 is a space defined by a front portion of the left wall 34, a front portion of the right wall 35, the front wall 36, the curved wall 80 of the bottom wall 37, and the expanded part 86 of the cover frame 33. Further, the developing chamber 8 is a space in a rear region of the developing-cartridge frame 2. Specifically, the development chamber 8 is a space defined by a rear portion of the left wall 34, a rear portion of the right wall 35, the arcuate wall 81 of the bottom wall 37, and the blade-mounting part 88 of the cover frame 33.

(2) Power Supply Unit

As shown in FIGS. 3A and 3B, the power supply unit 31 includes a supply electrode 95, an insulating member 97, and a developing electrode 98.

(2-1) Supply Electrode

As shown in FIGS. 3B and 5A, the supply electrode 95 is formed of an electrically conductive resin material, such as an electrically conductive POM (polyacetal), and is configured to electrically connect to the supply roller 5. In a side view, the supply electrode 95 is elongated from upper-front to lower-rear. The supply electrode 95 integrally includes a supply-electrode contact part 101 as an example of a contact portion, a supply-electrode fixing part 102, and a supply-electrode insertion part 103.

The supply-electrode contact part 101 constitutes an upper end portion of the supply electrode 95. The supply-electrode contact part 101 is configured to contact a first main electrode 155 described later. The supply-electrode contact part 101 has a general prismatic cylindrical shape that is elongated in the left-right direction and closed on its right end. The supply-electrode contact part 101 has a right surface defined as a supply-electrode contact surface 106 (an example of a contact surface). The supply-electrode contact part 101 has a front surface defined as a supply-electrode flat surface 107 as an example of a flat surface.

The supply-electrode fixing part 102 has a general plate-like shape that is substantially L-shaped in a side view. More specifically, the supply-electrode fixing part 102 extends first continuously downward from a left edge of a bottom end of the supply-electrode contact part 101, then bends and extends diagonally downward and rearward. The supply-electrode fixing part 102 has a first through-hole 105.

The first through-hole 105 is formed in an approximate vertical center region of the supply-electrode fixing part 102. The first through-hole 105 has a general circular shape in a side view and penetrates the supply-electrode fixing part 102 in the left-right direction. The first through-hole 105 has an inner diameter greater than an outer diameter of the electrode support shaft 52 provided on the right wall 35.

As shown in FIG. 5A, the supply-electrode insertion part 103 constitutes a lower end portion of the supply electrode 95. The supply-electrode insertion part 103 has a general cylindrical shape that is elongated in the left-right direction. The supply-electrode insertion part 103 has an inner diameter approximately equal to the outer diameter of the supply-roller shaft 13.

(2-2) Insulating Member

Figure 4B:
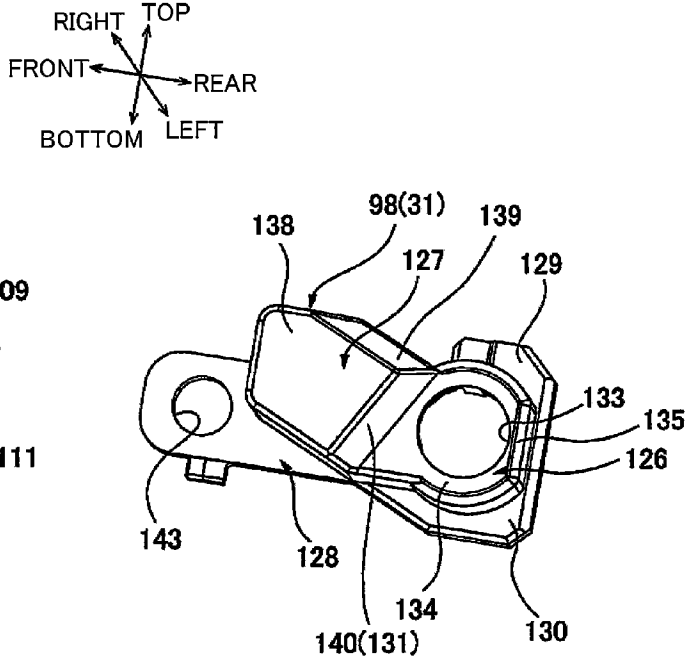
FIG. 4B is a perspective view of a developing electrode of the power supply unit shown in FIG. 3B as viewed from a right rear side thereof.
Figure 4A:
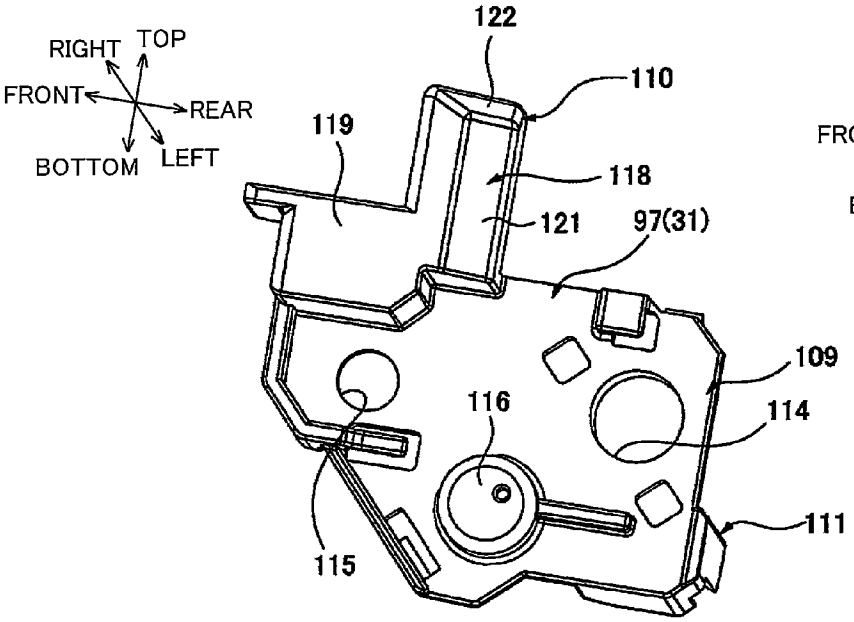
FIG. 4A is a perspective view of an insulating member of the power supply unit shown in FIG. 3B as viewed from a right rear side thereof.

As shown in FIG. 4A, the insulating member 97 is formed of an electrically insulating resin material, such as a POM (polyacetal), and functions to block an electrical connection between the supply electrode 95 and the developing electrode 98. The insulating member 97 integrally includes a bearing part 109, a protecting part 110, and an engaging part 111.

The bearing part 109 has a general plate-like shape that is substantially rectangular in a side view and elongated in the vertical and front-rear directions. The bearing part 109 has a developing-roller-shaft insertion hole 114, a second through-hole 115, and a supply-roller-shaft collar 116.

The developing-roller-shaft insertion hole 114 is formed in an approximate vertical center region of the bearing part 109 in a rear portion thereof. The developing-roller-shaft insertion hole 114 has a general circular shape in a side view and penetrates the bearing part 109 in the left-right direction. The developing-roller-shaft insertion hole 114 has an inner diameter approximately equal to the outer diameter of the developing-roller shaft 11.

The second through-hole 115 is formed in an approximate vertical center region of the bearing part 109 in a front portion thereof. The second through-hole 115 has a general circular shape in a side view and penetrates the bearing part 109 in the left-right direction. The second through-hole 115 has an inner diameter approximately equal to the outer diameter of the electrode support shaft 52.

The supply-roller-shaft collar 116 is provided in an approximate front-rear center region of the bearing part 109 at a lower portion thereof. The supply-roller-shaft collar 116 protrudes rightward from a right surface of the bearing part 109. The bearing part 109 has a general cylindrical shape that is closed on its right end. The supply-roller-shaft collar 116 has an inner diameter approximately equal to the outer diameter of the supply-roller shaft 13.

The protecting part 110 constitutes an upper front portion of the insulating member 97. The protecting part 110 has a general prismatic cylindrical shape that is elongated in the left-right direction and closed on its right end. In a side view, the protecting part 110 has a general L-shape. The protecting part 110 integrally includes a first protecting part 118 as an example of a first protecting portion, and a second protecting part 119 as an example of a second protecting portion.

The first protecting part 118 constitutes a rear portion of the protecting part 110. The first protecting part 118 has a general rectangular shape in a side view and is elongated in the vertical direction. A left end in a bottom portion of the first protecting part 118 is connected to a top edge of the bearing part 109.

A surface formed on a right rear portion of the first protecting part 118 slopes rightward toward the front. This sloped surface is defined as a first protecting guide surface 121 as an example of a sloped surface. Thus, the first protecting guide surface 121 slopes away from the right wall 35.

A surface formed on an upper right portion of the first protecting part 118 also slopes rightward toward the front. This sloped surface is defined as a second protecting guide surface 122. Thus, the second protecting guide surface 122 faces in a direction angled with respect to a direction in which the first protecting guide surface 121 faces.

Note that an upper edge of the first protecting guide surface 121 is formed continuously with a bottom edge of the second protecting guide surface 122.

The second protecting part 119 constitutes a front portion of the protecting part 110. The second protecting part 119 has a general rectangular shape in a side view that is elongated in the front-rear direction. The second protecting part 119 has a rear end formed continuously with a bottom end of the first protecting part 118. A left end in a bottom portion of the second protecting part 119 is connected to an upper front edge of the bearing part 109.

The engaging part 111 is provided on a left surface of the bearing part 109 at a lower rear corner thereof. The engaging part 111 has a general L-shape in a side view and protrudes leftward from the left surface of the bearing part 109.

(2-3) Developing Electrode

The developing electrode 98 is formed of an electrically conductive resin material, such as an electrically conductive POM (polyacetal), and is configured to electrically connect to the developing roller 4. As shown in FIG. 4B, the developing electrode 98 includes a developing-electrode cover part 126, a developing-electrode contact part 127, a connecting part 131, a developing-electrode plate part 128, an upper extension part 129, and a lower extension part 130.

The developing-electrode cover part 126 is configured to contact the developing-roller shaft 11. The developing-electrode cover part 126 is provided in an approximate vertical center of the developing electrode 98 in a rear portion thereof. The developing-electrode cover part 126 has a general thick plate-like shape that is substantially rectangular in a side view and has a substantial thickness in the left-right direction. The developing-electrode cover part 126 has a developing-roller-shaft insertion hole 133.

The developing-roller-shaft insertion hole 133 has a general circular shape in a side view and penetrates an approximate vertical and front-rear center region of the developing-electrode cover part 126 in the left-right direction. The developing-roller-shaft insertion hole 133 has an inner diameter approximately equal to the outer diameter of the developing-roller shaft 11.

A right surface of the developing-electrode cover part 126 excluding the developing-roller-shaft insertion hole 133 is defined as a developing-electrode-cover flat surface 134. The developing-electrode-cover flat surface 134 is formed flat and extends in the front-rear direction.

A surface formed on a right rear portion of the developing-electrode cover part 126 slopes leftward toward the rear. This sloped surface is defined as a first developing-electrode guide surface 135. Thus, a front edge of the first developing-electrode guide surface 135 is formed continuously with a rear edge of the developing-electrode-cover flat surface 134. Put another way, the first developing-electrode guide surface 135 defines an edge of the developing-electrode cover part 126 on an opposite side from the connecting part 131 described later.

The developing-electrode contact part 127 is provided in an approximate front-rear center region of the developing electrode 98. The developing-electrode contact part 127 is disposed adjacent to and frontward of the developing-electrode cover part 126. The developing-electrode contact part 127 protrudes farther rightward than the developing-electrode cover part 126. The developing-electrode contact part 127 has a general prismatic cylindrical shape that is closed on its right end.

The developing-electrode contact part 127 has a right surface defined as a developing-electrode-contact flat surface 138. The developing-electrode-contact flat surface 138 is formed flat, and extends in the front-rear direction and parallel to the developing-electrode-cover flat surface 134. The developing-electrode-contact flat surface 138 is positioned rightward of the developing-electrode-cover flat surface 134 by a distance of at least 0.5 mm and preferably at least 1.0 mm, for example, and by a distance no greater than 5.0 mm and preferably no greater than 2.0 mm, for example. Specifically, in this embodiment, the developing-electrode-contact flat surface 138 is positioned 1.4 mm rightward of the developing-electrode-cover flat surface 134.

A surface formed on an upper rear end portion of the developing-electrode contact part 127 extends in a direction from lower-rear to upper-front, and further slopes rightward toward the lower-front. This sloped surface is defined as a second developing-electrode guide surface 139.

The connecting part 131 is provided between the developing-electrode cover part 126 and the developing-electrode contact part 127 in the front-rear direction for connecting the developing-electrode cover part 126 and the developing-electrode contact part 127. The connecting part 131 extends in a direction from upper-rear to lower-front. In other words, the connecting part 131 extends in a direction approximately orthogonal to a mounting direction in which the developing cartridge 1 is mounted in the printer 15.

A surface formed on a right end of the connecting part 131 slopes rightward toward the upper-front. This sloped surface is defined as a connecting guide surface 140. Thus, the connecting guide surface 140 slopes away from the right wall 35.

The connecting guide surface 140 faces in a direction angled with respect to respective directions in which the first protecting guide surface 121, the second protecting guide surface 122, the first developing-electrode guide surface 135, and the second developing-electrode guide surface 139 face. The connecting guide surface 140 has a vertical dimension smaller than that of the first protecting guide surface 121 of the first protecting part 118. Further, an angle formed by the connecting guide surface 140 and the right wall 35 is smaller than an angle formed by the first protecting guide surface 121 and the right wall 35.

The developing-electrode plate part 128 constitutes a front portion of the developing electrode 98. The developing-electrode plate part 128 is disposed adjacent to and frontward of the developing-electrode contact part 127. The developing-electrode plate part 128 has a general plate-like shape that is substantially rectangular in a side view and extends continuously forward from a left edge of the developing-electrode contact part 127 at its lower front portion. The developing-electrode plate part 128 has a third through-hole 143.

The third through-hole 143 is formed in a front portion of the developing-electrode plate part 128. The third through-hole 143 has a general circular shape in a side view and penetrates the developing-electrode plate part 128 in the left-right direction. The third through-hole 143 has an inner diameter approximately equal to the outer diameter of the electrode support shaft 52.

The upper extension part 129 has a general plate-like shape that is substantially rectangular in a side view and extends upward from a top end of the developing-electrode cover part 126 at its left edge.

The lower extension part 130 has a general plate-like shape that is substantially rectangular in a side view and extends downward from a bottom end of the developing-electrode cover part 126 at its left edge.

(2-4) Assembled State of Supply Electrode, Insulating Member, and Developing Electrode As shown in FIGS. 3B and 5A, the supply electrode 95 is positioned relative to the right wall 35, with the electrode support shaft 52 of the right wall 35 received in the first through-hole 105 of the supply electrode 95 and with the right end of the supply-roller shaft 13 of the supply roller 5 received in the supply-electrode insertion part 103 of the supply electrode 95.

At this time, as shown in FIGS. 5A and 5B, the supply-electrode contact part 101 overlaps the front portion 60 of the first protruding wall 53 when projected in the left-right direction. Further, as shown in FIGS. 3B and 6A, the supply-electrode flat surface 107 of the supply-electrode contact part 101 faces the rear surface of the second protruding wall 54. More specifically, the second protruding wall 54 covers the supply-electrode flat surface 107 of the supply-electrode contact part 101 in its entirety. Further, the supply-electrode contact part 101 is positioned such that a gap is formed between the supply-electrode contact part 101 and the supply-roller shaft 13 in the front-rear direction.

As shown in FIGS. 3B and 4, the developing electrode 98 is assembled on the insulating member 97 from a right side thereof such that the third through-hole 143 of the developing electrode 98 is aligned with the second through-hole 115 of the insulating member 97 and the developing-roller-shaft insertion hole 133 of the developing electrode 98 is aligned with the developing-roller-shaft insertion hole 114 of the insulating member 97 in a side view.

The insulating member 97 and the developing electrode 98 assembled together in this way are then assembled to the right wall 35 on which the supply electrode 95 is positioned. Specifically, the insulating member 97 and the developing electrode 98 are assembled to the right wall 35, with the third through-hole 143 and the second through-hole 115 receiving the electrode support shaft 52, with the developing-roller-shaft insertion hole 133 and the developing-roller-shaft insertion hole 114 receiving the right end of the developing-roller shaft 11, and with the supply-roller-shaft collar 116 receiving the right end of the supply-roller shaft 13. At the same time, the engaging part 111 of the insulating member 97 contacts a right rear end portion of the bottom wall 37 of the developing-cartridge frame 2 from bottom and rear sides thereof Through these operations, the insulating member 97 and the developing electrode 98 are positioned relative to the right wall 35, as shown in FIG. 3A.

The supply electrode 95, the insulating member 97, and the developing electrode 98 are then fixed altogether to the right wall 35 with a screw screwed into the electrode support shaft 52. Thus, the supply electrode 95, the insulating member 97, and the developing electrode 98 are arranged adjacent to each other in the left-right direction.

At this time, the first protecting part 118 of the insulating member 97 is positioned adjacent to and rearward of the supply-electrode contact part 101, and the second protecting part 119 of the insulating member 97 is positioned adjacent to and below the supply-electrode contact part 101. Hence, the first protecting part 118 and the second protecting part 119 serve to protect the supply-electrode contact part 101 of the supply electrode 95.

Further, the first protecting part 118 of the insulating member 97 is disposed adjacent to and above the developing-electrode contact part 127, and the second protecting part 119 of the insulating member 97 is disposed adjacent to and frontward of the developing-electrode contact part 127. Hence, the first protecting part 118 and the second protecting part 119 also serve to protect the developing-electrode contact part 127 of the developing electrode 98.

Further, a right endface of the developing-roller shaft 11 is positioned flush with the developing-electrode-cover flat surface 134 of the developing electrode 98.

Further, a left edge portion of the first protecting part 118 of the insulating member 97 is arranged to face the bent portion 59 of the first protruding wall 53 in the front-rear direction.

4. Detailed Description of Process Cartridge

The process cartridge 17 is configured by mounting the developing cartridge 1 in the drum cartridge 24.

Figure 7B:
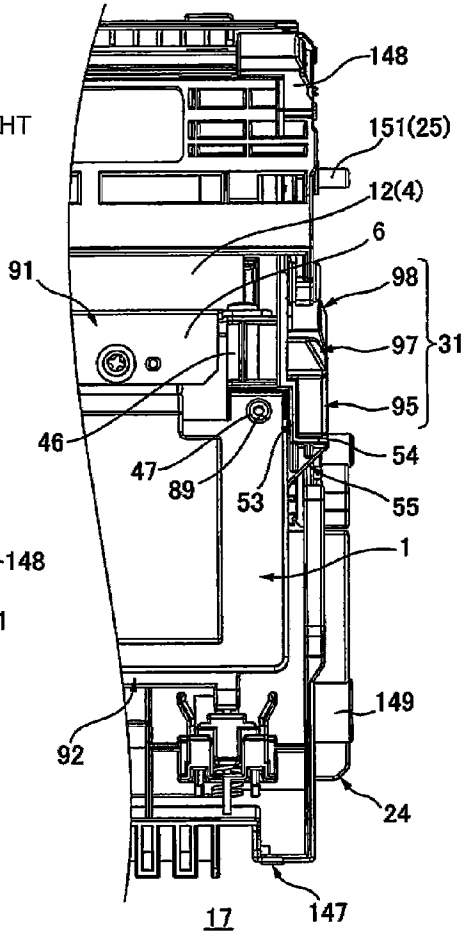
FIG. 7B is a plan view of a right end portion of the process cartridge shown in FIG. 7A.
Figure 7A:
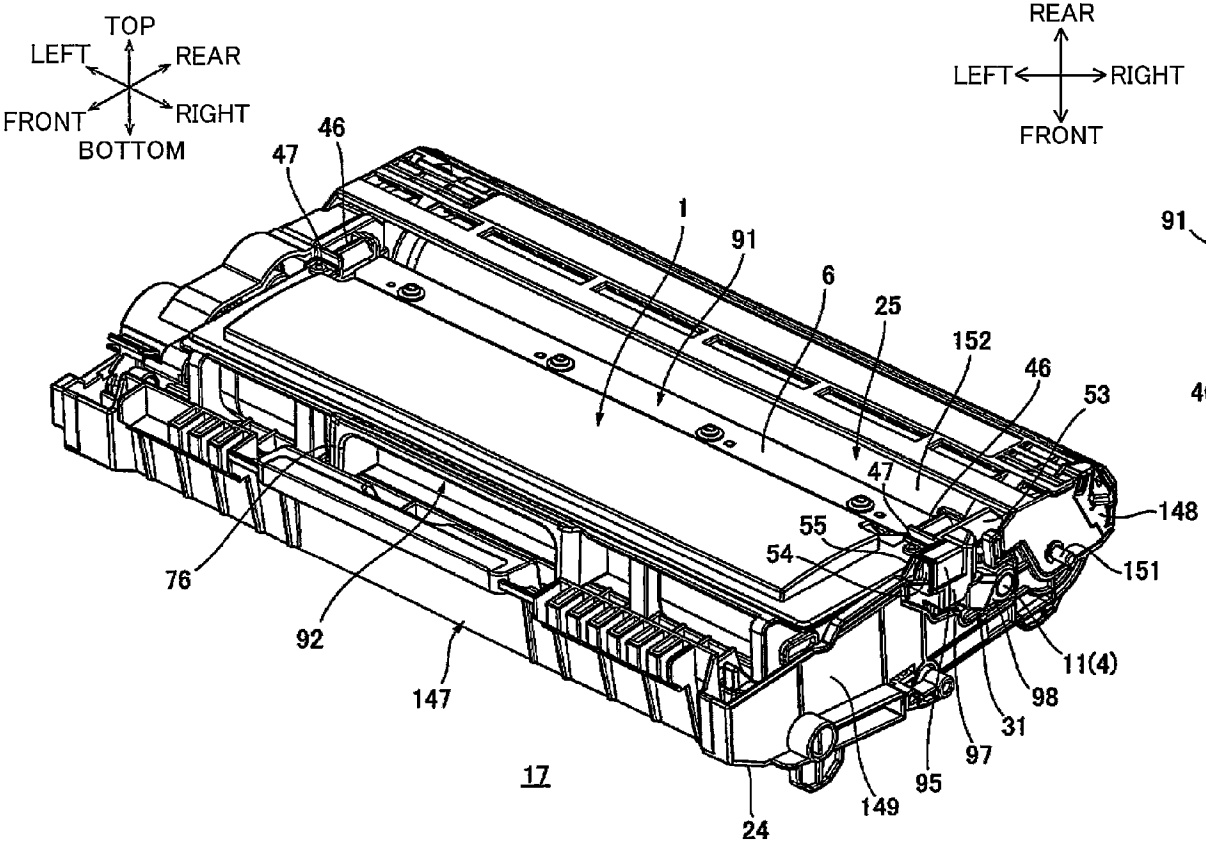
FIG. 7A is a perspective view of a process cartridge shown in FIG. 2 as viewed from a right front side thereof.

As shown in FIGS. 2 and 7A, the drum cartridge 24 includes a drum-cartridge frame 147, the photosensitive drum 25, and the scorotron charger 26.

The drum-cartridge frame 147 has a frame-like structure that is generally rectangular and has a closed bottom. A rear portion of the drum-cartridge frame 147 is defined as a drum accommodating section 148, and a front portion of the drum-cartridge frame 147 is defined as a developing-cartridge accommodating section 149.

The drum accommodating section 148 supports the photosensitive drum 25 and the scorotron charger 26.

As shown in FIGS. 7A and 7B, the photosensitive drum 25 includes a drum shaft 151, and a drum body 152. Left and right ends of the drum shaft 151 protrude outward in the left-right direction from corresponding left and right ends of the drum accommodating section 148. The drum body 152 covers a left-right center region of the drum shaft 151.

The developing-cartridge accommodating section 149 is configured to allow the developing cartridge 1 to be mounted therein and removed therefrom.

When the developing cartridge 1 is mounted in the developing-cartridge accommodating section 149 of the drum-cartridge frame 147, a rear edge portion of the developing-roller body 12 of the developing roller 4 contacts a front edge portion of the drum body 152 of the photosensitive drum 25, as shown in FIG. 2. Further, the power supply unit 31 of the developing cartridge 1 is disposed farther leftward than the right end of the drum shaft 151 and farther rightward than a right wall of the drum-cartridge frame 147 at this time.

This completes the configuration of the process cartridge 17.

5. Detailed Description of Main Casing

As shown in FIG. 6A, the main casing 16 includes the first main electrode 155 as an example of a main electrode, and a second main electrode 156 as an example of a main electrode.

The first main electrode 155 is arranged to contact the supply-electrode contact surface 106 of the supply-electrode contact part 101 of the supply electrode 95 in the left-right direction when the developing cartridge 1 has been mounted in the main casing 16. The first main electrode 155 is constantly urged leftward but can be displaced in the left-right direction. The first main electrode 155 is electrically connected to a power source (not shown) provided in the main casing 16.

The second main electrode 156 is arranged to contact the developing-electrode-contact flat surface 138 of the developing-electrode contact part 127 of the developing electrode 98 in the left-right direction when the developing cartridge 1 has been mounted in the main casing 16. The second main electrode 156 is constantly urged leftward but can be displaced in the left-right direction. The second main electrode 156 is electrically connected to the power source (not shown) in the main casing 16.

6. Mounting and Removal of Developing Cartridge Relative to Main Casing

Next, the operations for mounting and removing the developing cartridge 1 relative to the main casing 16 will be described.

To mount the developing cartridge 1 in the main casing 16, the operator first assembles the process cartridge 17 by placing the developing cartridge 1 in the developing-cartridge accommodating section 149 of the drum cartridge 24, as shown in FIGS. 7A and 7B.

Next, the operator opens the front cover 21, as shown in FIG. 2, and inserts the process cartridge 17 into the main casing 16 from front through the access opening 20 formed in the front end of the main casing 16.

Figure 8A:
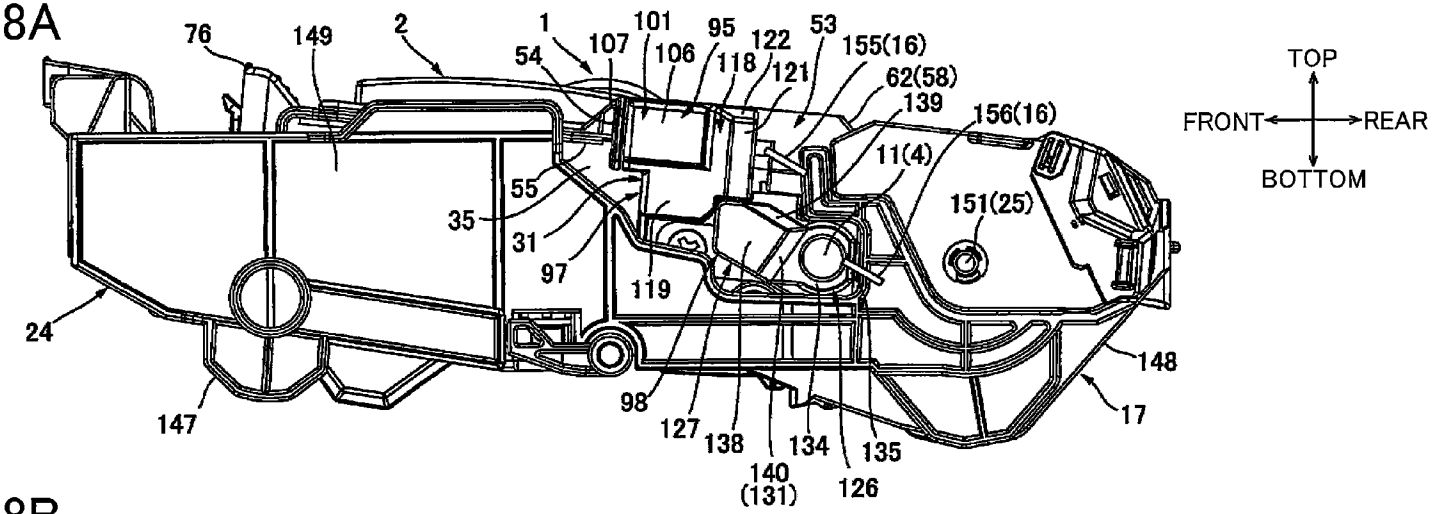
FIG. 8A is an explanatory view explaining mounting and removal operations of the process cartridge shown in FIG. 7A relative to the printer, in which a first main electrode provided in the printer is positioned rearward of the insulating member, and a second main electrode provided in the printer is in contact with the developing electrode.

As a result of this operation, the first main electrode 155 of the main casing 16 is positioned rearward of the first protecting part 118 of the insulating member 97, as shown in FIG. 8A.

Further, the second main electrode 156 of the main casing 16 contacts the developing-electrode cover part 126 of the developing electrode 98. The second main electrode 156 slides over the first developing-electrode guide surface 135 of the developing-electrode cover part 126 and moves rightward while being guided by the first developing-electrode guide surface 135.

Figure 8B:
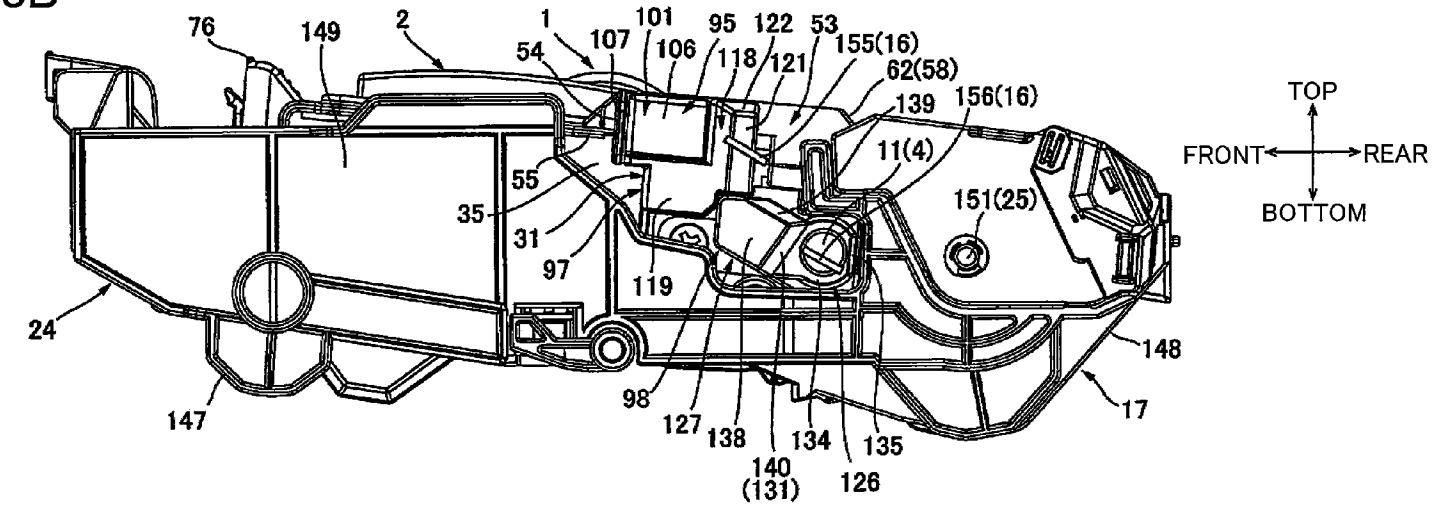
FIG. 8B is an explanatory view explaining the mounting and removal operations of the process cartridge relative to the printer, subsequent to a state shown in FIG. 8A, in which the first main electrode is in contact with the insulating member, and the second main electrode is in sliding contact with the developing electrode.

As the operator pushes the process cartridge 17 further into the main casing 16, the first main electrode 155 of the main casing 16 contacts the first protecting part 118 of the insulating member 97, as shown in FIG. 8B. Consequently, the first main electrode 155 slides over the first protecting guide surface 121 of the first protecting part 118 and moves rightward while being guided by the first protecting guide surface 121.

The second main electrode 156 also moves forward relative to the process cartridge 17 while sliding over the developing-electrode-cover flat surface 134 of the developing-electrode cover part 126 and the right endface of the developing-roller shaft 11.

Figure 9A:
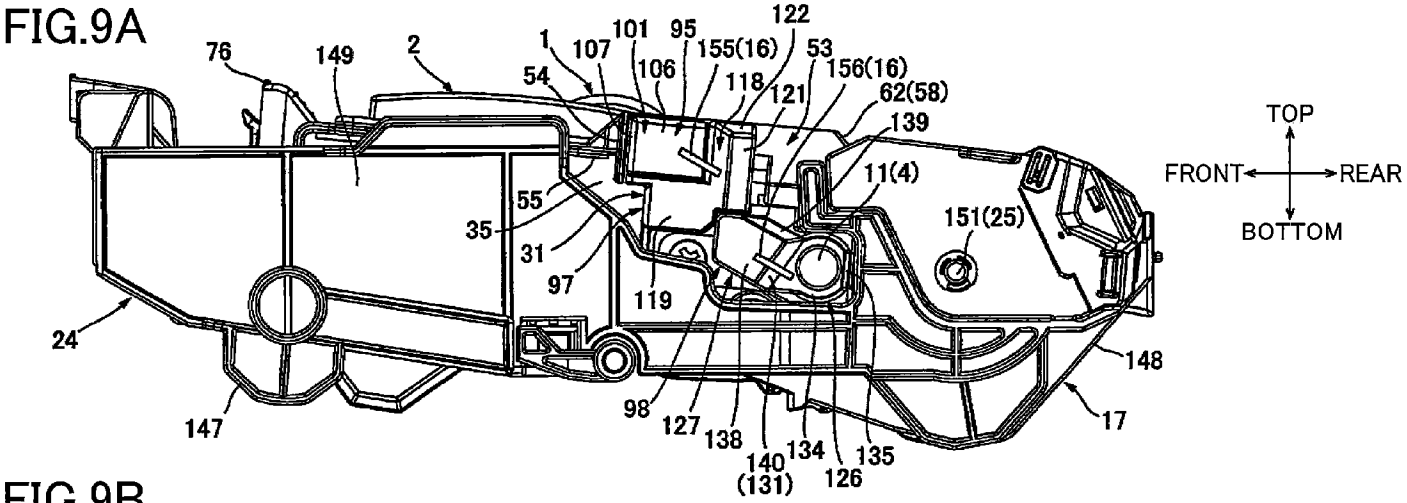
FIG. 9A is an explanatory view explaining the mounting and removal operations of the process cartridge relative to the printer, subsequent to a state shown in FIG. 8B, in which the first main electrode is in sliding contact with the insulating member and the supply electrode, and the second main electrode is in contact with a connecting part of the developing electrode.

As the operator pushes the process cartridge 17 further into the main casing 16, the first main electrode 155 moves forward relative to the process cartridge 17 while sliding over the right surface of the first protecting part 118 and the supply-electrode contact surface 106 of the supply-electrode contact part 101 of the supply electrode 95, as shown in FIG. 9A.

At the same time, the second main electrode 156 contacts the connecting part 131 of the developing electrode 98. The second main electrode 156 then slides over the connecting guide surface 140 of the connecting part 131 and moves rightward while being guided by the connecting guide surface 140.

Figure 9B:
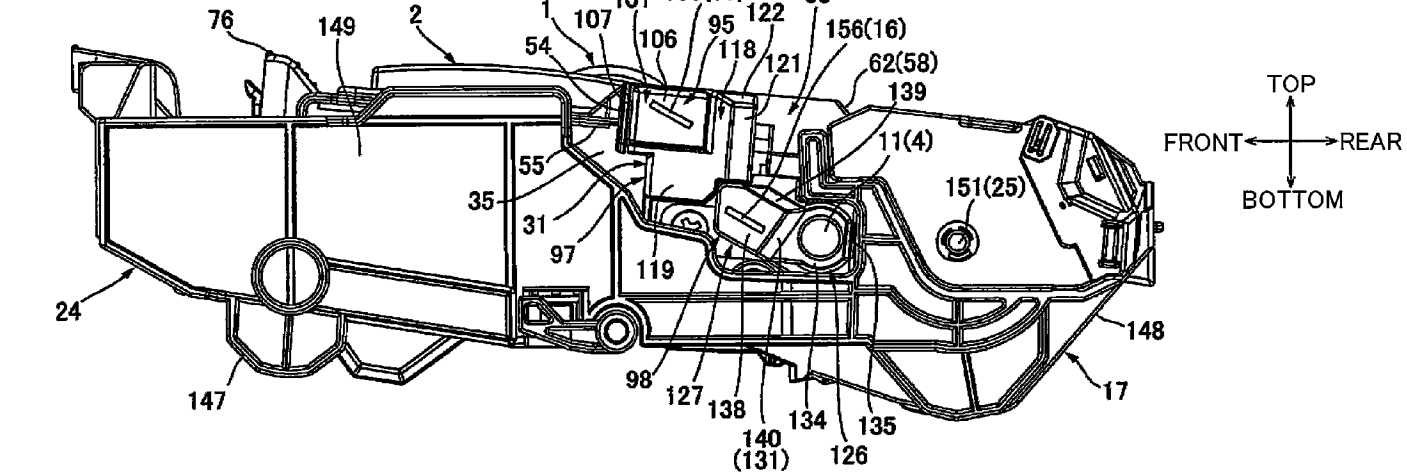
FIG. 9B is an explanatory view explaining the mounting and removal operations of the process cartridge relative to the printer, subsequent to a state shown in FIG. 9A, in which the first main electrode is in contact with the supply electrode and the second main electrode is in contact with the developing electrode.

As the operator pushes the process cartridge 17 further into the main casing 16, the first main electrode 155 contacts the supply-electrode contact surface 106 of the supply-electrode contact part 101 from a right side thereof, as shown in FIG. 9B.

At the same time, the second main electrode 156 contacts the developing-electrode-contact flat surface 138 of the developing-electrode contact part 127 from a right side thereof These steps complete the operation for mounting the process cartridge 17 in the main casing 16.

To remove the developing cartridge 1 from the main casing 16, the mounting operation described above is performed in reverse.

That is, the operator again opens the front cover 21, as shown in FIG. 2, and pulls the process cartridge 17 forward through the access opening 20.

Subsequently, the operator removes the developing cartridge 1 from the developing-cartridge accommodating section 149 of the drum cartridge 24, thereby completing the operation to remove the developing cartridge 1 from the main casing 16.

7. Operational Advantages (1) According to the developing cartridge 1 described above, when the developing cartridge 1 is mounted in the main casing 16, the first main electrode 155 first comes into contact with the first protecting part 118 of the insulating member 97, as shown in FIG. 8B. By providing the first protecting part 118 with the first protecting guide surface 121, the first main electrode 155 can be guided in a direction away from the right wall 35.

Thus, the first protecting part 118 serves to protect the supply electrode 95 and can suppress damage to the supply electrode 95.

(2) According to the developing cartridge 1 described above, as shown in FIG. 6A, the first main electrode 155 contacts the supply-electrode contact part 101 in the left-right direction.

Accordingly, the first main electrode 155 can be placed reliably in contact with the supply-electrode contact part 101 of the supply electrode 95.

(3) According to the developing cartridge 1 described above, as shown in FIG. 5A, the supply-roller shaft 13 and the supply-electrode contact part 101 are spaced apart from each other in the front-rear direction.

Accordingly, this arrangement prevents the supply-roller shaft 13 from contacting and damaging the first main electrode 155.

At the same time, electric power can be reliably supplied to the supply-roller shaft 13 through contact between the supply-electrode contact part 101 and the first main electrode 155.

(4) According to the developing cartridge 1 described above, as shown in FIG. 8B, the second protecting part 119 of the insulating member 97 can protect the supply-electrode contact part 101 when the developing cartridge 1 is mounted in the main casing 16, even if the developing cartridge 1 is incorrectly aligned when inserted into the main casing 16.

Thus, this construction more reliably suppresses damage to the supply electrode 95.

(5) According to the developing cartridge 1 described above, as shown in FIGS. 3A and 3B, the insulating member 97 integrally includes the first protecting part 118 and the second protecting part 119, thereby reducing the number of required parts while blocking an electrical connection between the developing electrode 98 and the supply electrode 95.

(6) According to the developing cartridge 1 described above, as shown in FIGS. 3A and 3B, the first protecting part 118 and the second protecting part 119 can protect the developing electrode 98 as well as the supply electrode 95.

(7) According to the developing cartridge 1 described above, as shown in FIGS. 5A and 6A, the developing cartridge 1 is configured to protect the front side of the supply-electrode contact part 101, thereby even better protecting the supply electrode 95.

(8) According to the developing cartridge 1 described above, as shown in FIG. 1B, the second protruding wall 54 can be integrally formed with the base frame 32 of the developing-cartridge frame 2, thereby reducing the number of required parts.

(9) According to the developing cartridge 1 described above, as shown in FIG. 6A, the supply-electrode contact surface 106 of the supply-electrode contact part 101 is formed flat and extends in the front-rear direction, enabling the first main electrode 155 to reliably contact the supply-electrode contact surface 106.

(10) According to the developing cartridge 1 described above, as shown in FIG. 6A, the second main electrode 156 can reliably contact the developing electrode 98 in order to supply electric power to the developing roller 4.

(11) According to the developing cartridge 1 described above, the supply electrode 95 and the developing electrode 98 shown in FIG. 3A are formed of an electrically-conductive resin material. Therefore, each of the supply electrode 95 and the developing electrode 98 is easy to form and can supply electric power reliably to the corresponding developing roller 4 and supply roller 5.

(12) According to the developing cartridge 1 described above, as shown in FIGS. 5A and 6A, the second protruding wall 54 supports and covers at least a portion of the supply electrode 95. Therefore, the second protruding wall 54 can suppress deformation in the supply electrode 95 even if the supply electrode 95 is contacted by components in the main casing 16 as the developing cartridge 1 is mounted in or removed from the main casing 16.

The second protruding wall 54 can also suppress damage to the supply electrode 95 as components in the main casing 16 initially contact the second protruding wall 54 when the developing cartridge 1 is mounted in or removed from the main casing 16.

Further, since the cover right end 67 of the second protruding wall 54 is connected to the right wall 35 by the connecting part 55, the connecting part 55 can reinforce the second protruding wall 54.

(13) According to the developing cartridge 1 described above, as shown in FIGS. 5A and 6A, when components in the main casing 16 contact the second protruding wall 54, the first sloped surface 70 guides these components rightward away from the second protruding wall 54 so that the developing cartridge 1 can be smoothly mounted in and removed from the main casing 16.

(14) According to the developing cartridge 1 described above, as shown in FIGS. 5A and 6A, when components in the main casing 16 contact the second protruding wall 54, the second sloped surfaces 71 guide these components upward away from the second protruding wall 54 so that the developing cartridge 1 can be more smoothly mounted in and removed from the main casing 16.

(15) According to the developing cartridge 1 described above, as shown in FIGS. 5A and 6A, the first rib 68 can reinforce the second protruding wall 54. Further, by providing the first sloped surface 70 of the first rib 68, the structure of the connecting part 55 can be simplified and components in the main casing 16 can be guided away from the second protruding wall 54 when contacting the second protruding wall 54.

Thus, the structure described above enables the developing cartridge 1 to be smoothly mounted in and removed from the main casing 16 while reducing manufacturing costs for the developing cartridge 1.

(16) According to the developing cartridge 1 described above, as shown in FIGS. 5A and 6A, the second rib 69 can further reinforce the second protruding wall 54. Further, by providing the second sloped surface 71 of the second rib 69, the structure of the connecting part 55 can be simplified and components in the main casing 16 can be guided away from the second protruding wall 54 when contacting the second protruding wall 54.

Thus, the structure described above enables the developing cartridge 1 to be more smoothly mounted in and removed from the main casing 16 while reducing manufacturing costs for the developing cartridge 1.

(17) According to the developing cartridge 1 described above, as shown in FIGS. 1B and 6B, the connecting part 55 is provided with the plurality of second ribs 69 to better reinforce the second protruding wall 54.

(18) According to the developing cartridge 1 described above, as shown in FIGS. 5A and 6A, the second protruding wall 54 can reliably protect the supply-electrode contact part 101 that is contacted by the first main electrode 155.

(19) According to the developing cartridge 1 described above, as shown in FIG. 6A, electric power can be supplied to the supply roller 5 through a simple construction in which the supply-electrode contact surface 106 of the supply-electrode contact part 101 extending flat in the front-rear direction is placed in contact with the first main electrode 155.

(20) According to the developing cartridge 1 described above, as shown in FIGS. 5A and 6A, the supply-electrode flat surface 107 is covered in its entirety by the second protruding wall 54, enabling the supply-electrode contact part 101 to be protected while leaving the supply-electrode contact surface 106 exposed to be contacted by the first main electrode 155 or the second main electrode 156.

(21) According to the developing cartridge 1 described above, as shown in FIGS. 3B and 5B, the developing roller 4 and the supply roller 5 are supported by the base frame 32 having the flange parts 45, the second protruding wall 54, and the connecting part 55, thereby improving the positioning accuracy of the developing roller 4 and the supply roller 5.

(22) According to the developing cartridge 1 described above, the supply electrode 95 shown in FIG. 3A is formed of an electrically conductive resin material. Accordingly, the supply electrode 95 can be formed easily while enabling electric power to be reliably supplied to the supply roller 5.

(23) According to the developing cartridge 1 described above, the first protruding wall 53 that protrudes higher than the joining surface 48 of the flange part 45 is disposed adjacent to the supply electrode 95, as shown in FIGS. 3A and 6B. Accordingly, the first protruding wall 53 reinforces the supply electrode 95 so that the supply electrode 95 is unlikely to break, even when the supply electrode 95 is contacted by components in the main casing 16.

Accordingly, by arranging the supply electrode 95 so as to protrude higher than the flange part 45 and by allocating sufficient size for the supply electrode 95 while reducing the size of other parts, it is possible to protect the supply electrode 95 while producing a more compact developing cartridge 1.

(24) According to the developing cartridge 1 described above, as shown in FIG. 6A, the first protruding wall 53 has a crank-like shape configured of the front portion 60, the rear portion 58, and the bent portion 59.

This arrangement increases the rigidity of the first protruding wall 53 for reliably protecting the supply electrode 95.

(25) According to the developing cartridge 1 described above, as shown in FIGS. 3A and 6A, the blade support part 46 is connected to and reinforced by the rear portion 58 of the first protruding wall 53.

Accordingly, the thickness-regulating blade 6 can be positioned precisely relative to the developing-cartridge frame 2 and assembled to the developing-cartridge frame 2.

(26) According to the developing cartridge 1 described above, as shown in FIG. 3A, the insulating member 97 blocks an electrical connection between the supply electrode 95 and the developing electrode 98 while the first protruding wall 53 protects the insulating member 97.

Further, the supply electrode 95 can be protected by the insulating member 97, as well as the first protruding wall 53.

(27) According to the developing cartridge 1 described above, as shown in FIGS. 3A and 6A, the insulating member 97 can be reliably positioned relative to the first protruding wall 53 by placing the insulating member 97 adjacent to the rear portion 58 in the left-right direction. Further, the first protruding wall 53 can aid in protecting the insulating member 97.

(28) According to the developing cartridge 1 described above, as shown in FIGS. 3A and 6A, the insulating member 97 is disposed so as to confront the bent portion 59 in the front-rear direction. Through this configuration, the first protruding wall 53 can better protect the insulating member 97.

(29) According to the developing cartridge 1 described above, as shown in FIGS. 1B and 6A, the positioning bosses 47 are disposed on the base frame 32, thereby improving the positioning accuracy of the positioning bosses 47 so that the cover frame 33 can be assembled to the base frame 32 with accuracy.

(30) According to the developing cartridge 1 described above, as shown in FIGS. 1B and 6A, each positioning boss 47 provided on the base frame 32 is surrounded by the first protruding wall 53 and the blade support part 46.

This arrangement can improve the positioning accuracy of the positioning bosses 47 and ensure the strength of the positioning bosses 47 so that the cover frame 33 can be assembled to the base frame 32 with even greater accuracy.

(31) According to the developing cartridge 1 described above, as shown in FIGS. 3A and 6A, the supply electrode 95 is supported by the second protruding wall 54 as well as the first protruding wall 53, thereby suppressing deformation in the supply electrode 95.

Thus, this configuration more reliably protects the supply electrode 95.

(32) According to the developing cartridge 1 described above, as shown in FIG. 1B, the second protruding wall 54 can be integrally formed with the first protruding wall 53, thereby reducing manufacturing costs for the developing cartridge 1.

(33) According to the developing cartridge 1 described above, as shown in FIG. 1B, the second protruding wall 54 is reinforced by joining the second protruding wall 54 to the flange part 45 of the right wall 35. Accordingly, the second protruding wall 54 can more reliably protect the supply electrode 95.

8. Second Embodiment

Next, a developing cartridge 100 according to a second embodiment of the present invention will be described with reference to FIG. 10, wherein like parts and components are designated with the same reference numerals to avoid duplicating description. In the following description, only parts differing from those of the first embodiment will be described in detail.

In the first embodiment described above, the connecting part 55 includes the single first rib 68, and the plurality of (two in the first embodiment) of second ribs 69, as shown in FIG. 1B.

Figure 10:
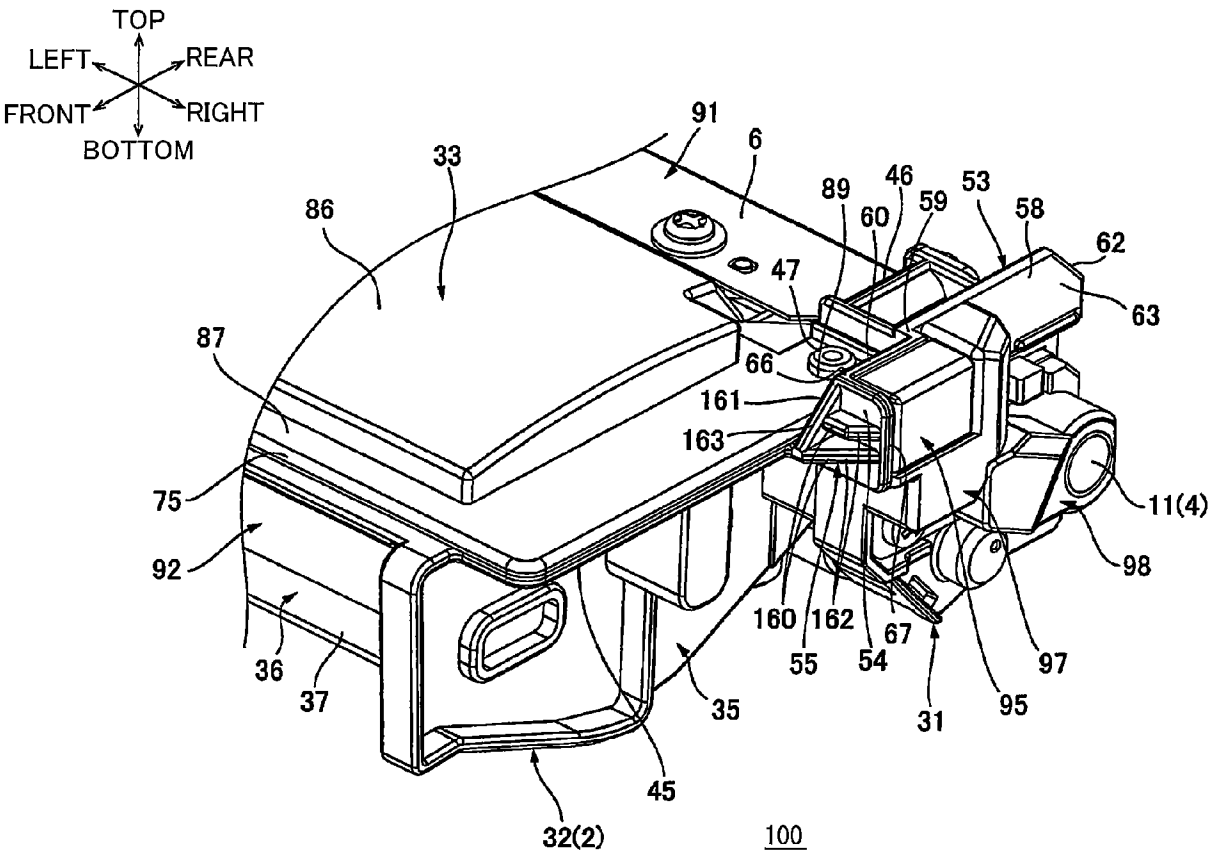
FIG. 10 is a perspective view of a right end portion of a developing cartridge according to a second embodiment of the present invention as viewed from a right front side thereof.

However, in the second embodiment shown in FIG. 10, the connecting part 55 includes a plurality of (two in the second embodiment) first ribs 160, and a single second rib 161.

The first ribs 160 are arranged at intervals in the vertical direction. The lower first rib 160 has a general plate-like shape that connects an approximate front-rear center region of the right edge of the right flange part 45 and the front surface of the cover right end 67 of the second protruding wall 54. The upper first rib 160 has a general plate-like shape that connects a right surface of the second rib 161 (described below) and the front surface of the cover right end 67 of the second protruding wall 54.

The first ribs 160 have right edges that extend to the right edge of the second protruding wall 54. Each first rib 160 has a front right portion that slopes rightward from front to rear, with the sloped surface being defined as a first sloped surface 162. Thus, the lower first rib 160 has a general triangular shape in a plan view, while the upper first rib 160 has a general trapezoidal shape in a plan view.

The second rib 161 has a general plate-like shape and connects a top surface of the lower first rib 160 and the front surface of the second protruding wall 54. Hence, the second rib 161 is aligned with the front portion 60 of the first protruding wall 53 when projected in the front-rear direction. The second rib 161 has an upper front portion that slopes upward from front to rear, with the sloped surface being defined as a second sloped surface 163. Thus, the second rib 161 has a general triangular shape in a side view.

The second embodiment described above can obtain the same operational advantages described in the first embodiment.

9. Modifications and Variations

While the present invention has been described in detail with reference to the embodiments thereof, it would be apparent to those skilled in the art that many modifications and variations may be made therein without departing from the spirit of the present invention.

For example, while the developing electrode 98 in the embodiments described above is integrally provided with the developing-electrode cover part 126, the developing-electrode contact part 127, and the connecting part 131, these constituent components may be provided as separate members. For example, the developing-electrode cover part 126 and the developing-electrode contact part 127 of the developing electrode 98 may be formed of an electrically-conductive resin material, while the connecting part 131 disposed between and connected to the developing-electrode cover part 126 and the developing-electrode contact part 127 may be formed of a metal material.

Further, for example, the connecting part 131 may be formed of an electrically insulating material, and the developing-roller shaft 11 and the developing-electrode contact part 127 may be connected to each other by an electrically conductive material arranged differently from the connecting part 131.

Further, in the embodiments described above, the supply electrode 95 integrally includes the supply-electrode contact part 101, the supply-electrode fixing part 102, and the supply-electrode insertion part 103, but these constituent components may be provided as separate members. For example, the supply-electrode contact part 101 and the supply-electrode insertion part 103 of the supply electrode 95 may be formed of an electrically-conductive resin material, and the supply-electrode fixing part 102 disposed between and connected to the supply-electrode contact part 101 and the supply-electrode insertion part 103 may be formed of a metal material.

Alternatively, the supply-electrode fixing part 102 may be formed of an electrically insulating material, and the supply-roller shaft 13 and the supply-electrode contact part 101 may be connected to each other by an electrically-conductive material arranged differently from the supply-electrode fixing part 102.

Further, the developing-electrode cover part 126 need not be configured to cover the entire circumferential surface of the developing-roller shaft 11, but may be configured to cover at least a portion of the circumferential surface of the developing roller shaft 11.

Further, the developing-electrode cover part 126 may be configured to cover the right endface of the developing-roller shaft 11 rather than leaving the endface exposed.

Further, instead of the developing roller 4 described above, a developing sleeve, a brush roller, or other member may be used as the developer-carrying body.

Further, the developing-electrode-cover flat surface 134 and the developing-electrode-contact flat surface 138 may possess irregularities in the left-right direction to an extent that does not interfere with the developing cartridge 1 being mounted in the printer 15.

Further, the angle formed by the connecting guide surface 140 and the right wall 35 can be set to any desired value, but should be at least 1 degrees and less than 90 degrees.

Further, while the base frame 32 in the embodiments described above integrally includes the first protruding wall 53 and the second protruding wall 54, the first protruding wall 53 and the second protruding wall 54 may be provided as separate members.

Alternatively, the first protruding wall 53 and the second protruding wall 54 may be provided on the cover frame 33 rather than the base frame 32.

Further, the second protruding wall 54 should cover at least a portion of the supply-electrode flat surface 107 of the supply-electrode contact part 101, but need not cover the entire supply-electrode flat surface 107.

Further, the first protruding wall 53 and the second protruding wall 54 should cover at least a portion of the supply-electrode contact part 101 in the vertical direction.

What is claimed is:

1. A developing cartridge configured to be mounted in a main casing of an image forming apparatus in a mounting direction, the developing cartridge comprising:

a developing roller configured to rotate about a first rotation axis extending in a first direction that is orthogonal to the mounting direction;

a supply roller configured to rotate about a second rotation axis extending in the first direction and configured to supply the developing roller with developer;

a casing configured to accommodate developer therein, the casing including a first wall portion orthogonal to the first direction and a second wall portion orthogonal to the first direction and facing the first wall portion in the first direction, the first direction being a direction from the first wall portion toward the second wall portion;

a developing electrode configured to be electrically connected to the developing roller and disposed at a position adjacent to the second wall portion in the first direction;

a supply electrode configured to be electrically connected to the supply roller and disposed at a position adjacent to the second wall portion in the first direction; and a first protecting portion configured to protect the supply electrode and disposed at a position downstream relative to the supply electrode in the mounting direction, the first protecting portion having a sloped surface having a first end and a second end upstream relative to the first end in the mounting direction, the sloped surface sloping away from the second wall portion in the first direction toward the second end.

2. The developing cartridge as claimed in claim 1, wherein the supply electrode includes a contact portion configured to contact a main electrode of the image forming apparatus in the first direction.

3. The developing cartridge as claimed in claim 2, wherein the supply roller includes a supply roller shaft extending in the first direction, the contact portion and the supply roller shaft being spaced apart from each other in the mounting direction.

4. The developing cartridge as claimed in claim 2, further comprising a second protecting portion disposed at a position adjacent to the contact portion in a second direction that is orthogonal to the first direction and the mounting direction.

5. The developing cartridge as claimed in claim 4, further comprising an insulating member configured to block electrical connection between the developing electrode and the supply electrode, the insulating member integrally including the first protecting portion and the second protecting portion.

6. The developing cartridge as claimed in claim 4, wherein the first protecting portion is disposed at a position adjacent to the developing electrode in the second direction, the second protecting portion being disposed at a position adjacent to the developing electrode in the mounting direction.

7. The developing cartridge as claimed in claim 4, wherein the first protecting portion is disposed at a position downstream relative to the contact portion in the mounting direction, and wherein the casing further includes:

a cover portion protruding in the first direction from the second wall portion and disposed at a position upstream relative to the contact portion in the mounting direction; and a rib provided at the second wall portion and extending in the mounting direction, the rib being disposed at a position adjacent to the contact portion in the first direction.

8. The developing cartridge as claimed in claim 2, wherein the contact portion has a contact surface orthogonal to the first direction, the contact surface being configured to contact the main electrode.

9. The developing cartridge as claimed in claim 1, wherein the developing electrode and the supply electrode are formed of an electrically conductive resin material.

10. A developing cartridge comprising:

a developing roller configured to rotate about a first rotation axis extending in a first direction;

a supply roller configured to rotate about a second rotation axis extending in the first direction and configured to supply the developing roller with developer;

a supply electrode configured to be electrically connected to the supply roller; and a casing configured to accommodate developer therein, the casing including a first frame and a second frame assembled to the first frame, the second frame comprising:

a first wall portion extending in a second direction that is orthogonal to the first direction;

a second wall portion extending in the second direction and facing the first wall portion in the first direction, the first direction being a direction from the first wall portion to the second wall portion, the supply electrode being disposed at a position adjacent to the second wall portion in the first direction;

a joining portion protruding in the first direction from the second wall portion and assembled to the first frame;

a cover portion protruding in the first direction from the second wall portion and covering the supply electrode, the cover portion having a first end connected to the second wall portion and a second end opposite to the first end in the first direction; and a connecting portion connecting the joining portion and the second end of the cover portion.

11. The developing cartridge as claimed in claim 10, wherein the second frame further comprises a grip portion, wherein the casing has a first edge and a second edge opposite to the first edge in the second direction, the developing roller being disposed at the first edge, the grip portion being disposed at the second edge, the second direction being a direction from the second edge to the first edge, wherein the connecting portion has a first sloped surface having an upstream end and a downstream end in the second direction, the first sloped surface sloping in the first direction toward the downstream end.

12. The developing cartridge as claimed in claim 11, wherein the connecting portion has a second sloped surface having an upstream end and a downstream end in the second direction, the second sloped surface sloping in a third direction toward the downstream end of the second sloped surface, the third direction being a direction from the second frame to the first frame and orthogonal to the first direction and the second direction.

13. The developing cartridge as claimed in claim 12, wherein the connecting portion includes a first rib protruding in the first direction from the joining portion, the first rib has the first sloped surface.

14. The developing cartridge as claimed in claim 13, wherein the connecting portion includes a second rib protruding in the third direction from the first rib, the second rib has the second sloped surface.

15. The developing cartridge as claimed in claim 14, wherein the second rib comprising a plurality of second ribs.

16. The developing cartridge as claimed in claim 10, wherein the supply electrode includes a contact portion configured to contact a main electrode provided in a main casing of an image forming apparatus, the contact portion comprising:

a contact surface orthogonal to the first direction and configured to contact the main electrode; and a flat surface orthogonal to the contact surface, the cover portion facing the flat surface in the second direction and configured to cover the flat surface in its entirety.

17. A developing cartridge comprising:

a developing roller configured to rotate about a first rotation axis extending in a first direction;

a supply roller configured to rotate about a second rotation axis extending in the first direction and configured to supply the developing roller with developer;

a supply electrode configured to be electrically connected to the supply roller; and a casing including a first frame and a second frame, the casing further including a developer accommodating chamber defined by the first frame and the second frame, the second frame having a joining surface joined to the first frame, the second frame including a rib facing the supply electrode in the first direction, the rib extending from the joining surface in a second direction that is orthogonal to the joining surface;

wherein the rib includes:

a first portion extending in a third direction that is orthogonal to the first direction and the second direction, the first portion facing the supply electrode in the first direction;

a second portion extending in the third direction; and a third portion extending in the first direction and connecting the first portion and the second portion; and wherein the second frame has a cover portion facing the supply electrode in the third direction to cover the supply electrode, the cover portion being connected to the first portion of the rib.

18. The developing cartridge as claimed in claim 17, further comprising a layer thickness regulation blade configured to regulate a layer thickness of developer carried on the developing roller, and wherein the second frame includes a support portion configured to support the layer thickness regulation blade, the support portion being connected to the second portion of the rib.

19. The developing cartridge as claimed in claim 17, further comprising:

a developing electrode configured to be electrically connected to the developing roller; and an insulating member disposed between the developing electrode and the supply electrode and configured to block electrical connection between the developing electrode and the supply electrode, the insulating member being disposed at a position adjacent to the second portion of the rib in the first direction.

20. The developing cartridge as claimed in claim 19, wherein the insulating member faces the third portion in the third direction.

21. The developing cartridge as claimed in claim 17, wherein the first frame has a through-hole, and wherein the second frame has a protruding portion protruding in the second direction from the joining surface, the protruding portion being configured to be inserted into the through-hole, the protruding portion being disposed at a position adjacent to the first portion in the first direction.

22. The developing cartridge as claimed in claim 17, wherein the joining surface and the cover portion are integrally formed.

* * * * *